US008926440B2

(12) United States Patent
Jacobi

(10) Patent No.: US 8,926,440 B2
(45) Date of Patent: Jan. 6, 2015

(54) REVERSE SWING OSCILLATING AMUSEMENT RIDE

(71) Applicant: S&S Worldwide, Inc., Logan, UT (US)

(72) Inventor: Timothy R. Jacobi, Hyde Park, CA (US)

(73) Assignee: S & S Worldwide, Inc., Logan, UT (US)

( * ) Notice: Subject to any disclaimer, the term of this patent is extended or adjusted under 35 U.S.C. 154(b) by 142 days.

(21) Appl. No.: 13/678,445

(22) Filed: Nov. 15, 2012

(65) Prior Publication Data

US 2013/0123030 A1 May 16, 2013

Related U.S. Application Data

(60) Provisional application No. 61/559,862, filed on Nov. 15, 2011.

(51) Int. Cl.

| | |
|---|---|
| ***A63G 27/04*** | (2006.01) |
| ***A63G 31/00*** | (2006.01) |
| ***A63G 27/02*** | (2006.01) |
| *A63G 27/00* | (2006.01) |

(52) U.S. Cl.

CPC ..... *A63G 31/00* (2013.01); *A63G 27/02* (2013.01)

USPC ..... 472/30; 472/46

(58) Field of Classification Search

CPC ..... A63G 1/00; A63G 1/24; A63G 1/26; A63G 1/30; A63G 27/00; A63G 27/02; A63G 27/04; A63B 19/00; A63B 19/04; A63B 69/00; G09B 9/00; G09B 9/12

USPC ..... 472/28, 30, 31, 44, 47, 112, 130, 136

See application file for complete search history.

(56) References Cited

U.S. PATENT DOCUMENTS

| | | | | |
|---|---|---|---|---|
| 2,357,481 | A * | 9/1944 | Mallon | 434/55 |
| 4,898,377 | A * | 2/1990 | Roche | 472/30 |
| 5,803,815 | A * | 9/1998 | Kitchen | 472/44 |
| 5,941,777 | A * | 8/1999 | Moser et al. | 472/44 |
| 5,947,828 | A * | 9/1999 | Fabbri | 472/30 |
| 5,989,127 | A * | 11/1999 | Kitchen et al. | 472/44 |
| 6,315,674 | B1 * | 11/2001 | Slade et al. | 472/131 |
| 6,875,118 | B1 * | 4/2005 | Checketts | 472/119 |
| 6,988,118 | B2 * | 1/2006 | Chiou | 708/492 |

* cited by examiner

*Primary Examiner* — Kien Nguyen
(74) *Attorney, Agent, or Firm* — Richard D. Clarke

(57) ABSTRACT

This application provides a multiple or single arm oscillating, optionally rotating amusement ride with reverse pendulum oscillating arm or arms that are angularly mounted to a horizontal tubular frame member of the rotating supporting structure. In one embodiment, there is a moveable adjustable counterbalance weight. The unique principal of the ride is that it that when the ride is rotating and the oscillating arm is moved from the lower position to the upper position the rotational velocity is increased through conservation of angular momentum producing a spinning "Ice dancer" effect. Tie rods or optionally a gimble and cable system is used to maintain stability and upright positioning of the gondola.

18 Claims, 21 Drawing Sheets

REVERSE SWING OSCILLATING AMUSEMENT RIDE

FIELD OF THE INVENTION

This application provides a reverse pendulum single or multiple arm, oscillating, and optionally rotating amusement ride where one or more arms with rider carriages or gondolas oscillate up and down initiated with a counterbalance weight while the ride is rotating. More particularly, the a amusement ride features a movable counterbalance weight, and swings in a reverse pendulum or reverse swing action for a pleasing ride experience for riders.

BACKGROUND OF THE INVENTION

A wide variety of amusement rides exist where the occupants ride in passenger carriages that rotate around a central axis along with rides that oscillate in a back and forth action using a counter balance. Many of these rides are often cumbersome taking a large amount of room and provide only one or two alternating actions. The multiple arm oscillating, rotating amusement ride is an amusement ride based off angular momentum, a physical principle entirely underutilized, by the amusement industry. The ride will change shape through simple mechanisms that will affect its angular velocity which is normally free to change due to inertial changes. This unique style of thrill ride with numerous alternating actions has been developed with a central unit that will rotate on a vertical axis in either direction with one or more oscillating arms pivoting on a horizontal axis that have passenger carriages at the distal ends that additionally freely rotate. The passenger units remain upright through a four-bar linkage or cable and gimble system.

Numerous innovations for amusement rides have been provided in the prior art that are described as follows. Even though these innovations may be suitable for the specific individual purposes to which they address, they differ from the present design as hereinafter contrasted. The following is a summary of those prior art patents most relevant to this application, at hand; as well as a description outlining the difference between the features of the multiple arm oscillating, rotating amusement ride and the prior art.

U.S. Pat. No. 5,941,777 of Alfeo Moser et al, describes an amusement ride presenting a platform; two parallel vertical uprights extending upwards from the platform; two arms fitted to respective uprights and rotated by drive means about a first horizontal axis; and a passenger car fitted to the arms and rotating about a second axis; characterized in that the car presents a supporting structure, and three rows of seats fitted to the structure and all facing in the same direction This patent describes an amusement ride with two parallel vertical uprights extending upwards from the base with two rotating arms having a single passenger car. It does not incorporate the pendulum or rotational action of the multiple arm oscillating, rotating amusement ride.

U.S. Pat. No. 5,989,127 of William Joel Kitchen tells of an amusement ride including a tower that pivotably supports an elongated boom that includes an extended end and a pivot. A passenger carriage is pivotably attached to the extended end of the boom. The shorter end of the boom includes a moveable counterweight that is operable for raising the boom. The boon is then locked, the counterweight is moved, and the boom is released to swing freely. The movable counterweight includes first and second storage tanks and a counterweight fluid, and at least one pump for moving the counterweight fluid between the first and second storage tanks. Passengers are loaded into the passenger carriage when the boom is in the down position. The boom is then raised by moving the counterweight fluid into the first storage tank. After the boom is raised, a brake is set to lock the boom in the raised position, and the counterweight fluid is moved into the second storage tank. The operator then lowers the boom by releasing the brake. The boom swings through approximately 270 degrees, and the passenger carriage may make a 360 degree loop at the end of the first swing.

This patent tells of a fluid actuated oscillating, boom amusement ride where the passenger carriage has the capability of swinging a 360 degree loop. This ride uses just one elongated boom with a single passenger carriage and does not rotate at the base.

U.S. Pat. No. 6,315,674 of E. Clay Slade et al. relates to an amusement ride for providing vertical movement of a passenger is disclosed. Typically, a support tower having a vertical movement mechanism defining a vertical movement path is present. The carriage is typically coupled to the movement mechanism for providing travel along the vertical movement path. Connected to the carriage is a support structure which extends radially from the carriage for supporting passenger seats. The support structure can be a wall, a rigid post, or some other structure extending outwardly front the tower. In one embodiment, the seats can be positioned along the support structure such that a first seat is closer to the carriage than a second seat. The passenger seats can be positioned to face outwardly or toward other passenger seats. Additionally, the passenger seats can be coupled to the support structure along a support structure side, above the support structure, beneath the support structure, or any combination thereof.

This patent relates to an amusement ride with a vertical movement of a passenger carriage up and down a support tower. It does not have any kind of oscillation or rotational movement of multiple passenger carriages.

U.S. Pat. No. 6,875,118 of Stanley J. Checketts describes a pneumatically actuated swing ride that has rigid swing members rotating about a shall in a pendulum style of swinging ride. The ride operates with rigid swing members raising one or more riders in a scat platform or gondola up and then accelerates them down through an arc in the pendulum style of swinging movement. The controlled upward movement, a brief delay, and the accelerated downward movement produce weightlessness in the ride that is unmatched in the industry. The weightless effect is incurred at both ends of the arc and every time the cycle is made. By using a pneumatic cylinder, air is used as an air cushion both accelerating and decelerating the ride, giving complete control of the ride.

This patent describes a pneumatically actuated swing ride that has rigid swing members rotating about a shaft in a pendulum style of swinging ride but does not rotate at the base to produce a spinning ice dancer effect and can only incorporate a single passenger carriage.

None of these previous efforts, however, provides the benefits attendant with the multiple arm oscillating, rotating amusement ride. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the multiple arm oscillating, rotating amusement ride in detail it is to be understood that the design is not limited in its application to the details of construction and to the arrangement, of the components set forth in the following description or illustrated in the drawings. The multiple arm oscillating, rotating amusement ride is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of a multiple arm oscillating, rotating amusement ride is to provide an amusement ride with a variety of different movements on three separate axes.

Another advantage of the multiple arm oscillating, rotating amusement ride is that when the ride is rotating and the oscillating arm is moved from the lower position to the upper position the rotational velocity is increased by the inertia created producing the spinning ice dancer effect.

Another advantage of the multiple arm oscillating, rotating amusement ride is that the passengers in the carriage are always in the upright position.

Another advantage of the multiple arm oscillating, rotating amusement ride is that with this angular attachment, while the arms are operating in unison, their pivoting action puts the passenger carriage in close proximity to the previous location of the passenger carriage of the adjacent oscillating arm.

Another advantage of the multiple arm oscillating, rotating amusement ride is the passenger carriages are constructed with a freely spinning base.

Another advantage of the multiple arm oscillating, rotating amusement ride is a variety of different styles of passenger carriages or gondolas can be used with this amusement ride. In one embodiment, passengers in each carriage are facing inward towards each other, and they ma influence the carriages angular velocity through a steering wheel fixed to the seat base.

Yet another advantage of the multiple arm oscillating, rotating amusement ride is that with oscillating arms angularly mounted to the horizontal tubular frame member of the supporting structure it reduces the footprint of the overall ride.

And still another advantage of the multiple arm oscillating, rotating amusement ride is that each of the oscillating arm assemblies are linked together with redundant safety features. In one embodiment, this safety feature is achieved through linked hydraulic cylinders. In another embodiment, it is achieved through connected gearing.

A further advantage of the ride is the mobile counterweight system which allows for controlled accelerations throughout the swing, arc regardless of loading conditions.

A further advantage of the multiple arm oscillating, rotating amusement ride is that by inverting the ride on the rotating support structure, the oscillating arms will work in a downward pendulum movement instead of an upward pendulum movement.

These together with other advantages of the multiple arm oscillating, rotating amusement ride, along with the various features of novelty, which characterize the design, are pointed out with particularity in the claims annexed to and forming a part of this disclosure. For a better understanding of the multiple arm oscillating, rotating amusement ride, its operating advantages and the specific objects attained by its uses, reference should be made to the accompanying drawings and descriptive matter in which there are illustrated preferred embodiments of the multiple arm oscillating, rotating amusement ride. There has thus been outlined, rather broadly, the more important features of the design in order that the detailed description thereof that follows may be better understood, and in order that the present contribution the art may be better appreciated. There are additional features of the multiple arm oscillating, rotating amusement ride that will be described hereinafter and which will form the subject matter of the claims appended hereto.

The multiple arm oscillating, rotating amusement ride consists of a standard gear crane bearing rotational drive system, which rotates about a vertical axis, that is secured to a surface. The only unique feature in this portion is that the ride will spin freely on the vertical axis when the arms fold up, so the base is free to increase or decrease its angular speed as its total inertia changes. One or more oscillating arm units are attached to the central structure of the standard gear crane bearing rotational drive system by the means of upper and lower attachment collars on the central axis. In another embodiment, the rotational drive system is located along the outside truss supports with wheel which run on a circular track for a larger base than the centrally located crane bearing.

The oscillating arms are angularly mounted to the horizontal tubular frame member of the supporting afro lure, reducing the footprint of the overall ride. With this angular attachment, while the arms are operating in unison, their pivoting action puts the passenger carriage in close proximity to the previous location of the passenger carriage of the adjacent oscillating arm. At the distal end of the oscillating arm is the passenger carriage counter balanced by the means of a counter balancing weight at the other end of the oscillating arm. The passenger carriages on the preferred embodiment are constructed with a freely spinning, spring cushioned base with seats back to back that remain in the horizontal position during the complete ride. A simple four bar, or cabling system keeps the seats level, and will maintain a redundancy where if one of the bars should tail the seats will not tip. The spinning, of the passenger carriage is restricted during loading and unloading, when a brake is engaged. It must be understood that a wide variety of passenger carriages or gondolas can be adapted including the tea cup style with passengers facing together or of the Dumbo cartoon character style of passenger carriages and will still remain within the scope of this application. The unique feature adapted in this ride is that when the passenger carriages are at the horizontal position the rotation is slowed down and when the passenger carriages ate at the elevated position the rotation is increased by inertia producing the effect of an ice skater when they spin on the ice.

There are optionally two hydraulic systems moving the arms. The two systems are independent safety systems to keep the arms synchronized together. The safety synchronization cylinders are what guarantee that the arms do not inn into each other. They each synchronize the arms moving together and they are based off hydraulic fluid that cannot be compressed. It is important that they have rods sticking out both ends of the cylinder, that way the fluid displaced at the bottom of the cylinder will flow into the top of the next cylinder so all the arms will move together. There are alternate ways of timing the arms together by having gear mechanisms in the center meshing them together and would be covered within the scope of this application. The safety system will be a key part to this ride.

The quick reverse pendulum or trebuchet action of the ride is a new concept within the amusement ride industry. The mobile counterweight allows the ride to access the loading condition and move the counterweight to a specific position based upon the load for an optimum rider experience. After the pendulum motion starts, the frictional losses may be overcome by a minimally sized drive motor.

An alternate embodiment of the multiple arm oscillating, rotating amusement ride would have similar oscillating arm mechanisms on an elevated rotating central structure with the pendulum movement of the arms in the downward direction instead of in the upward direction. In another embodiment, the arms do not miss each other in their oscillations. Instead, their plane of oscillation intersects the main ride vertical axis, such that adjacent arms cannot collide. The difference between this embodiment and other existing rides is that this ride is generally free to rotate angularly due to inertia changes, whereas existing rides are not. Another difference between this embodiment and other existing rides is that the arm movement of this ride is necessarily synchronized to make inertia changes more dramatic.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the multiple arm oscillating rotating amusement ride. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the multiple arm oscillating, rotating amusement ride and together with the description, serve to explain the principles of this application.

For a fuller understanding of the nature and advantages of the multiple arm oscillating, rotating amusement ride, reference should be had to the following detailed description taken in conjunction with the accompanying drawings which are incorporated in and form a part of this specification. The drawings illus rate embodiments of the design and together with the description, serve to explain the principles of this application.

DETAILED DESCRIPTION OF THE PREFERRED EMBODIMENTS

Figure 1:
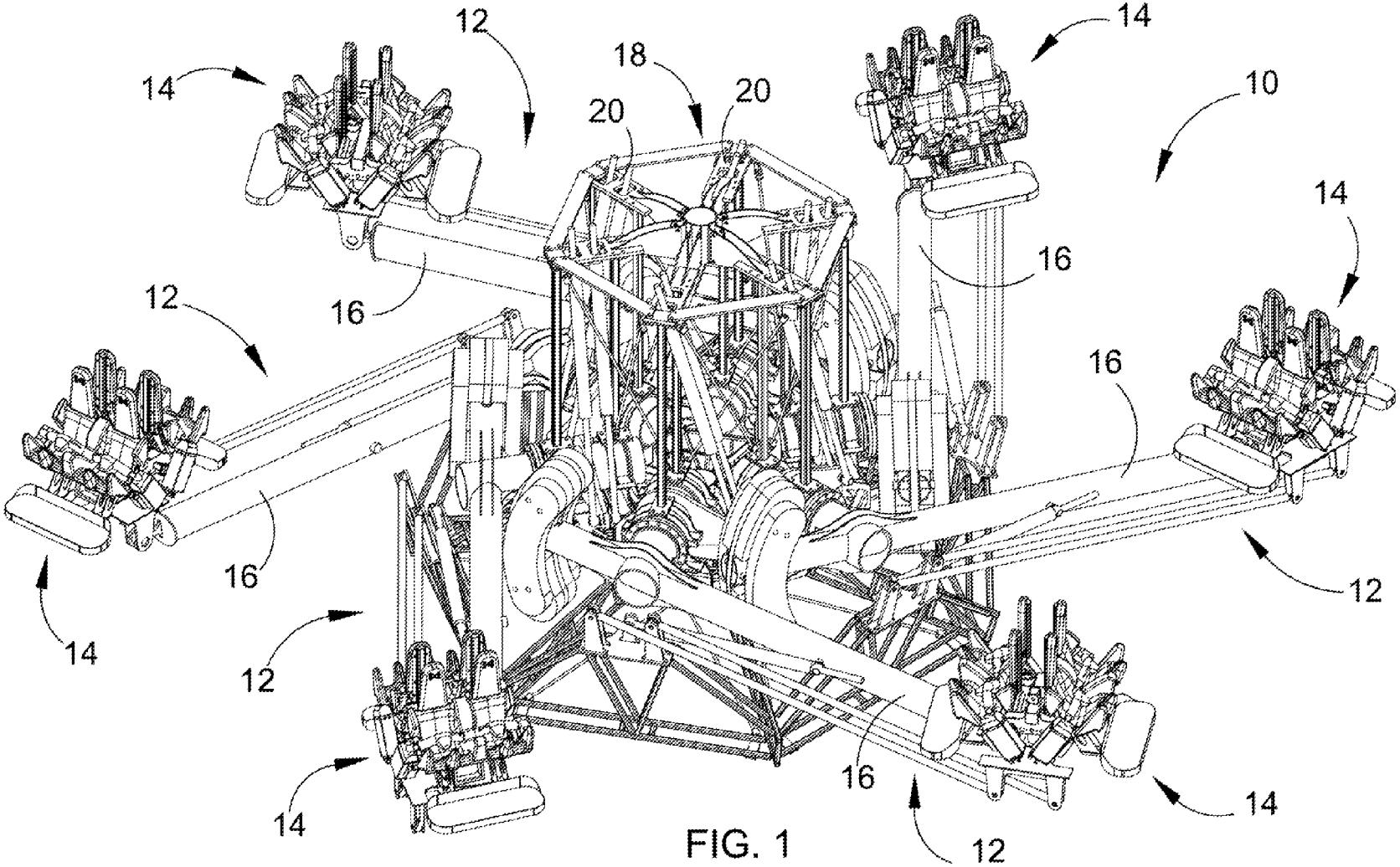
FIG. 1 depicts a perspective view of the multiple arm oscillating, rotating amusement ride with the oscillating arm in the lowered position.

Referring now to the drawings, wherein similar parts of the multiple arm oscillating, rotating amusement ride 10 are identified by like reference numerals. There is seen in FIG. 1 a perspective view of the multiple arm oscillating, rotating amusement ride 10 illustrating the oscillating arm assembly 12 with the oscillating arms in the lowered position and the passenger carriages 14 attached at the distal ends of the tubular support members 16. The upper rotational drive support structure 18 is connected to the oscillating arm upper section 20 of each of the oscillating arm assemblies 12.

Figure 2:
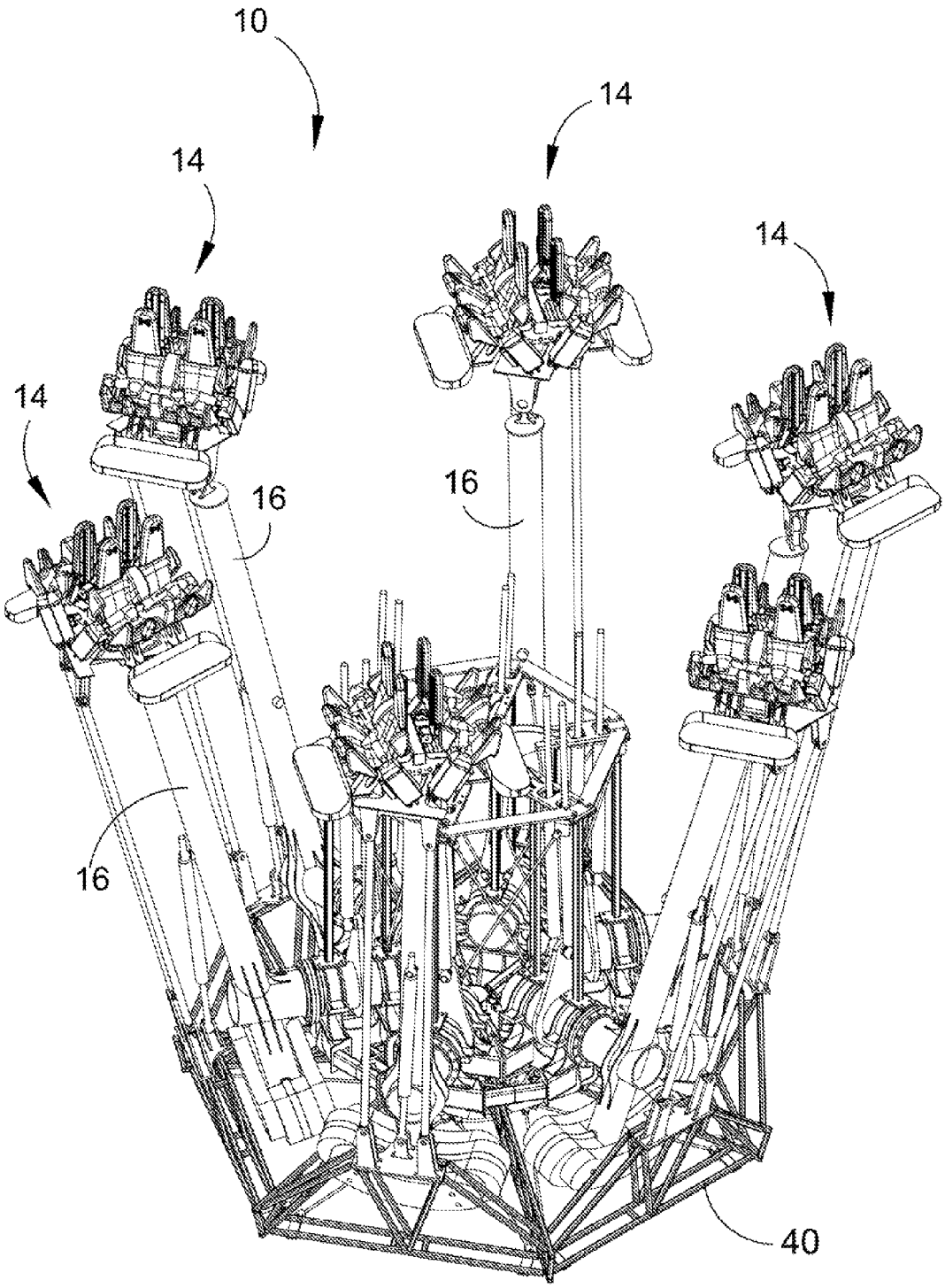
FIG. 2 depicts a perspective view of the multiple arm oscillating, rotating amusement ride with the oscillating arm in the raised position.

FIG. 2 depicts a perspective view of the multiple arm oscillating, rotating amusement ride with the oscillating arm in the raised position illustrating the extreme difference in the positioning of the oscillating arms from that indicated in FIG. 1.

Figures 3, 4, 5:
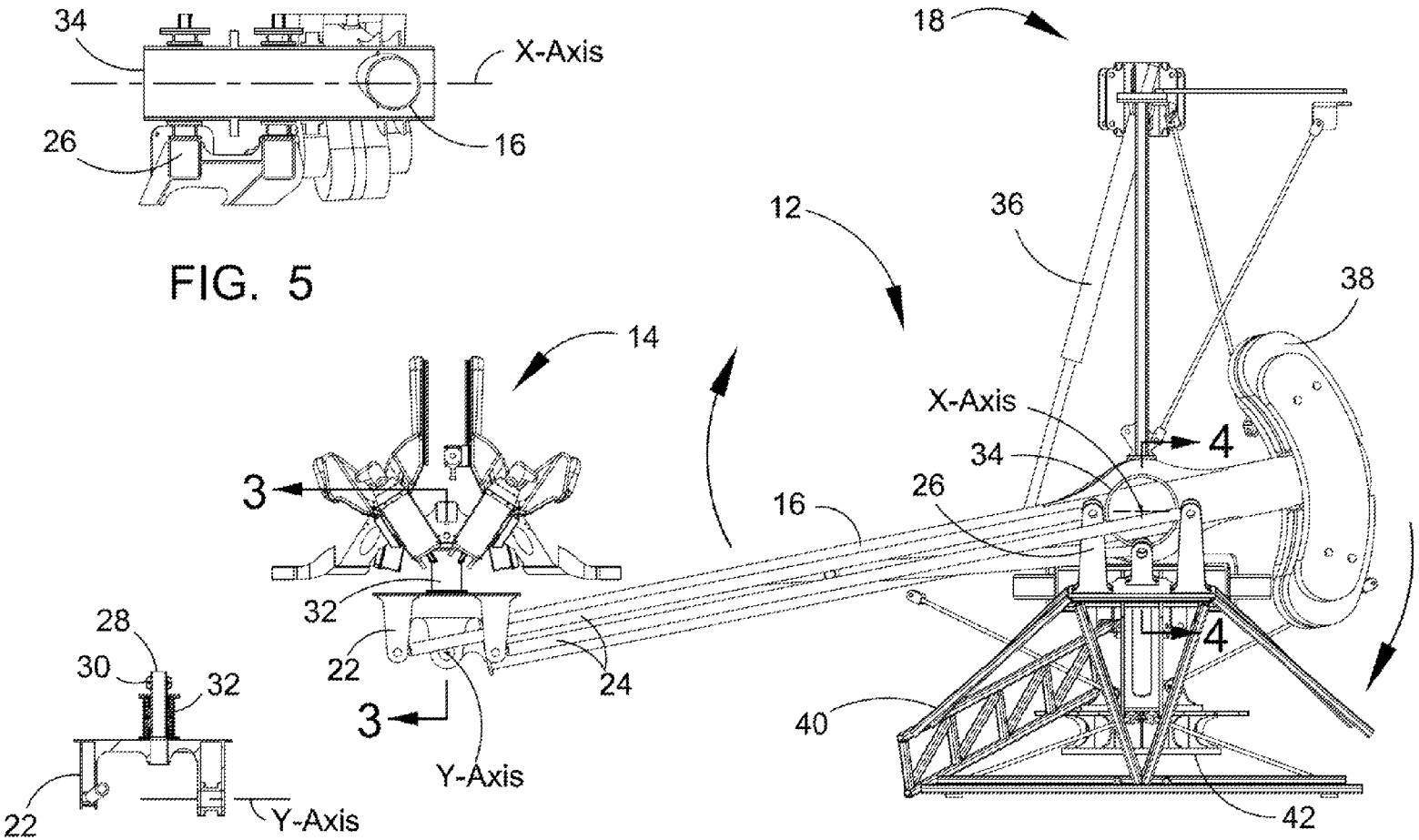
FIG. 3 depicts a side view of the oscillating arm assembly approaching the lowered position.
FIG. 4 depicts a cross section of the passenger carriage mounting frame.
FIG. 5 depicts a cross section of the oscillating arm assembly mounting structure.

FIG. 3 depicts a side view of the oscillating arm assembly 12 approaching the lowered position consisting of a tubular support member 16 with the passenger carriage 14 attached at the distal end by the means of the pivoting carriage mounting frame 22. The pivoting carriage mounting frame 22 pivots about the Y-Axis keeping the passenger carriage 14 in a horizontal position by the means of the two parallel passenger carriage support bars 24 attached to the primary support structure 26. The passenger carriage 14 is attached to the pivoting carriage mounting frame 22 by the means of the carriage mounting shaft 28 having a carriage hearing 30 that allows the passenger carriage 14 to spin freely unless the brake is applied depicted in FIG. 4. The carriage mounting shaft 28 is held captive within a spring cushion mechanism 32 attached to the pivoting carriage mounting frame 22. The oscillating arm assembly 12 oscillates about a horizontal tubular frame member 34 with its centerline on the X-Axis that is attached to the primary support structure 26. The drive cylinder 36 initiates the oscillating motion is connected to the oscillating arm upper section 20 (as seen in FIG. 1). A counter balancing weight 38 on the end of the tubular support member 16 maintains the smooth motion to the ride. Attached to the primary support structure 26 are the truss support unit 40 and the lower base mounting bearing 42 driven by the standard gear crane bearing rotational vertical drive system producing the rotation in the ride. FIG. 5 depicts a cross section of the oscillating arm 12 primary support structure 26 with the horizontal tubular frame member 34 illustrating its centerline on the X-Axis.

Figure 6:
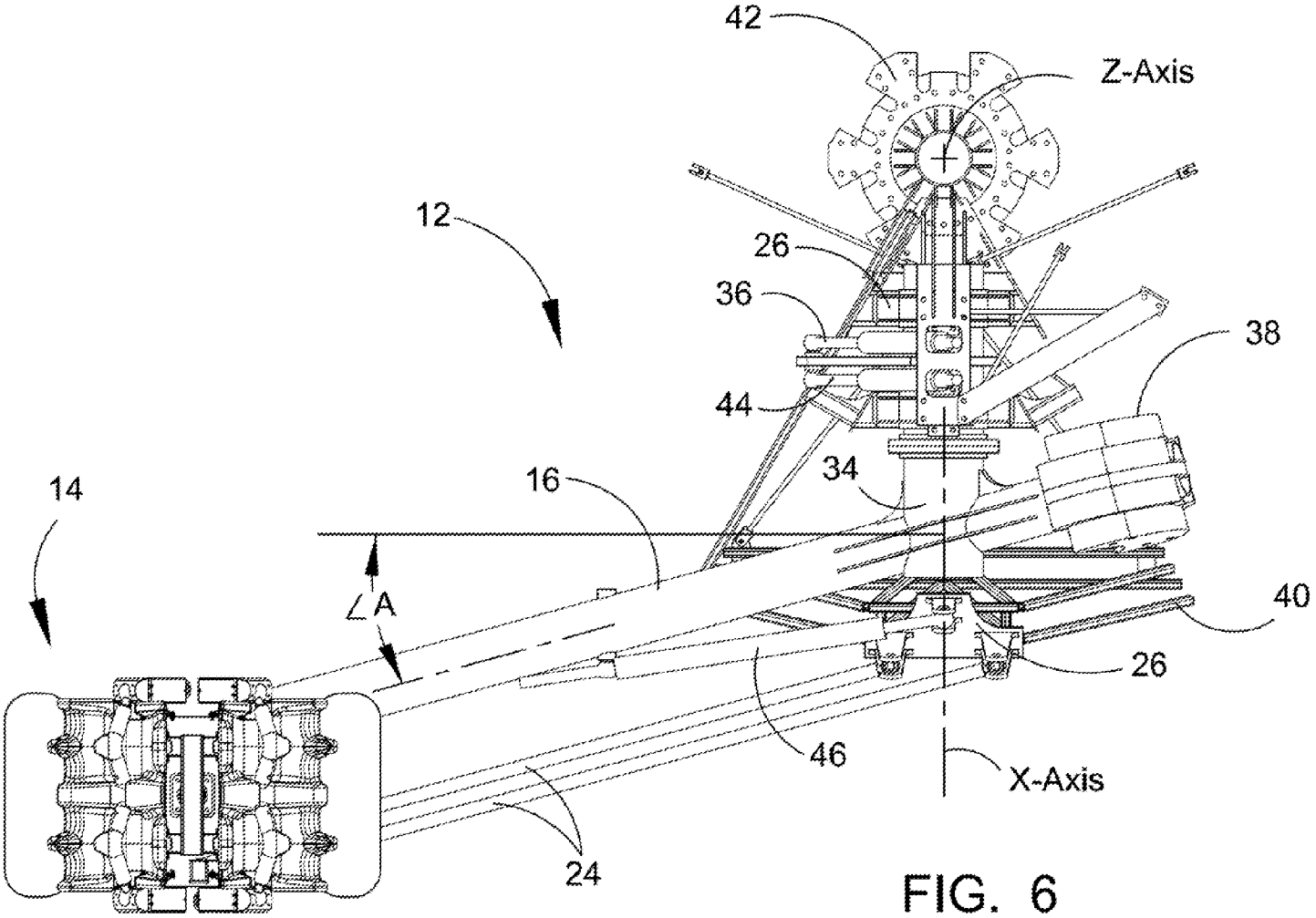
FIG. 6 depicts a top view of a single oscillating arm assembly.

FIG. 6 depicts a top view of a single oscillating arm assembly 12 assembly illustrating the Angle A where the centerline of the tubular support member 16 varies front a line perpendicular to the X-Axis, or the centerline of the horizontal tubular frame member 34. The angle shown as sixteen degrees may vary from zero to thirty degrees depending upon the number of oscillating arm assemblies 12 on the ride and will remain within the scope of this application. A notable feature here is that with the Angle A, when the oscillating arm assembly 12 is in the lowered position as depicted, the rotation speed will be slower than when it is in the raised position where the passenger carriage 14 is closer to the center Z-Axis of the ride and the rotational speed is increased by inertia giving the spinning ice dancer effect. The primary safety synchronization cylinder 44 is shown with a secondary safety synchronization cylinder 46 attached from the tubular support member 16 to the primary support structure 26.

Figure 7:
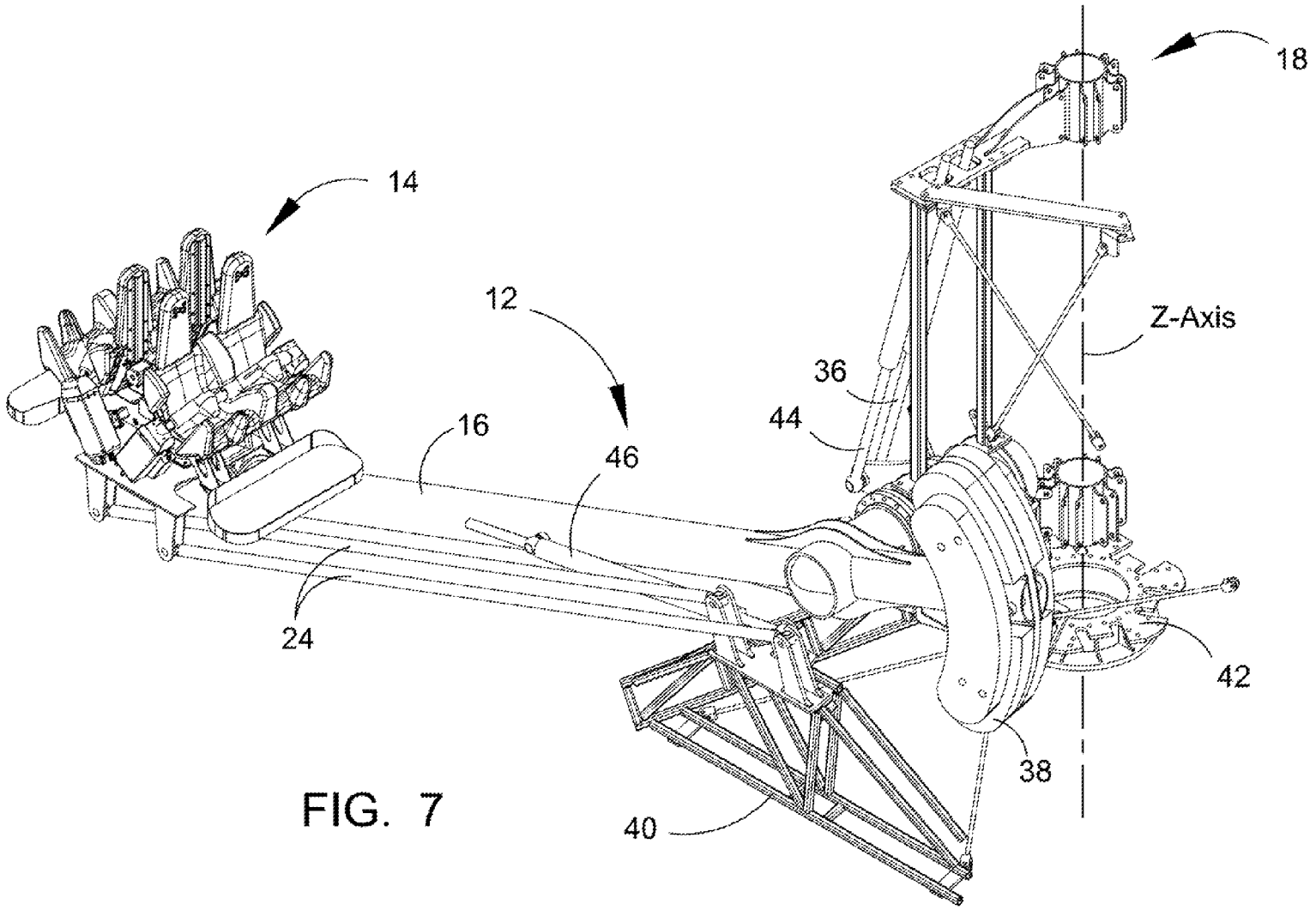
FIG. 7 depicts a perspective view of a single oscillating, arm assembly in the lowered position illustrating the central vertical axis about which the ride rotates.
Figure 8:
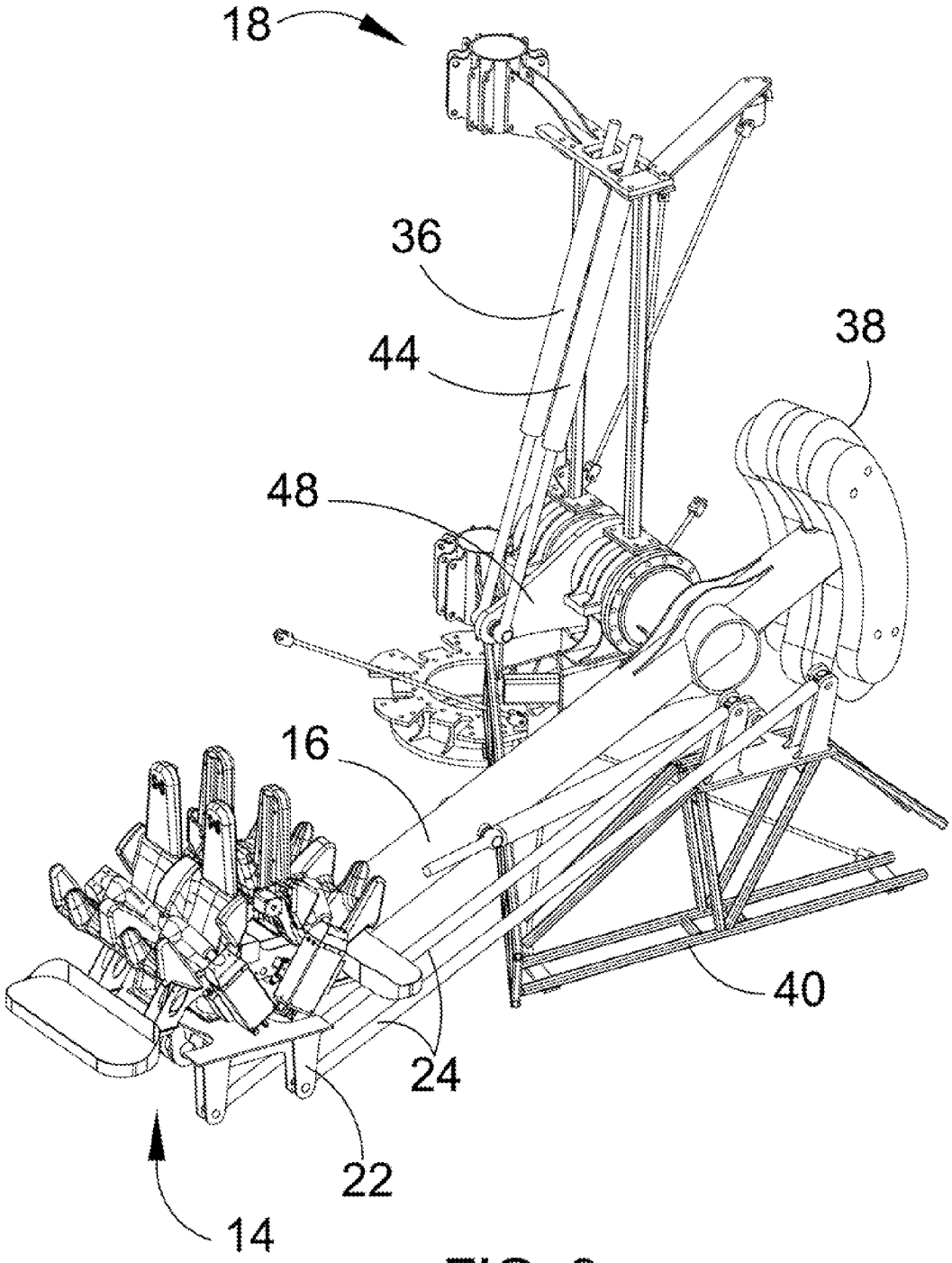
FIG. 8 depicts a perspective view of a single oscillating arm assembly in the lowered position.

FIG. 7 depicts a perspective view of a single oscillating arm assembly 12 in the lowered position illustrating the central vertical Z-Axis about which the ride rotates. FIG. 8 depicts a perspective view of a single oscillating arm assembly 12 in the lowered position illustrating the position of the lever arm 48 connected to the primary safety synchronization cylinder 44.

Figure 9:
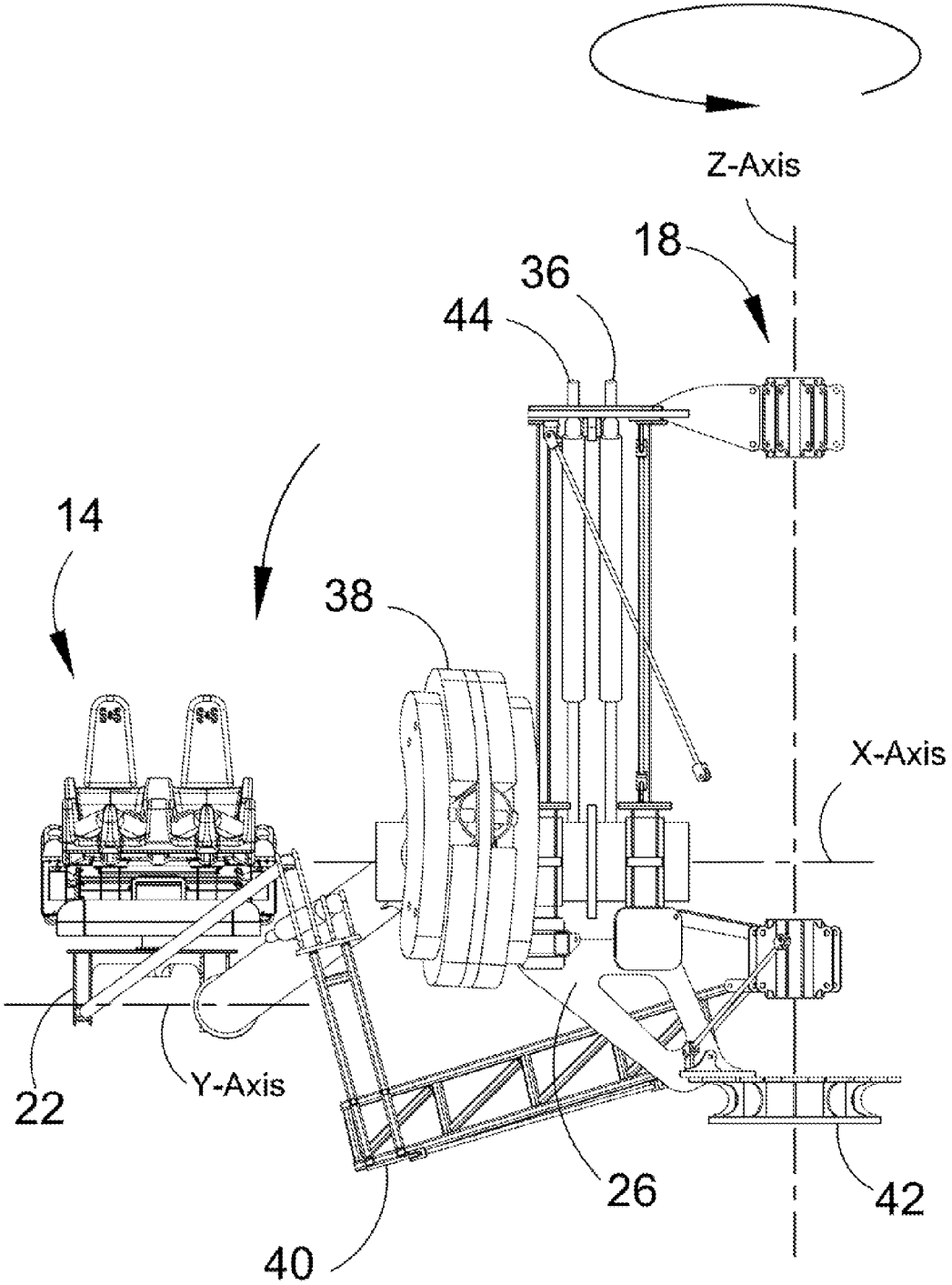
FIG. 9 depicts a rear view of a single oscillating arm assembly in the lowered position with the vertical centerline which the rides rotates and the horizontal centerline which the oscillating arm moves back and forth depicted.

FIG. 9 depicts a rear view of a single oscillating arm assembly 12 in the lowered position with the vertical centerline Z-Axis on which the rides rotates and the horizontal centerline X-Axis which the oscillating arm assembly 12 moves back and forth on, along with the Y-Axis that the passenger carriage rotates on to keep the riders in the horizontal position. The rotational arrow and downward movement arrow indicate the directional movements of the oscillating arms when the ride is operating, The fact that the X-Axis and the Y-Axis are parallel and perpendicular to the Z-Axis is notable but it must be clear that the parallel and perpendicular factors may vary to some degree remaining within the scope of this application.

Figure 10:
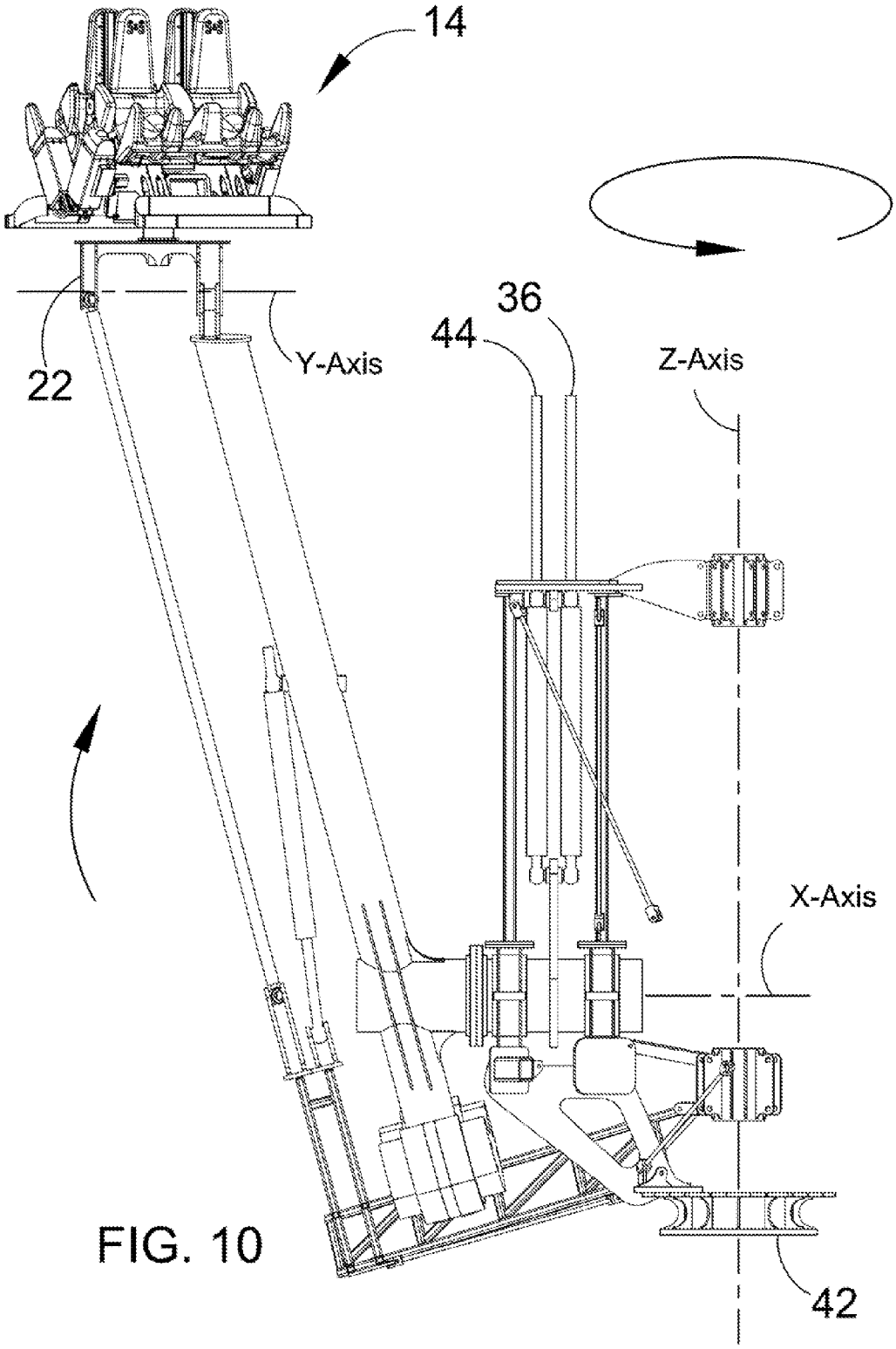
FIG. 10 depicts a perspective view of a single oscillating arm assembly in the raised position with the vertical centerline which the rides rotates and the horizontal centerline which the oscillating arm moves back and forth depicted.

FIG. 10 depicts a rear view of a single oscillating arm assembly 12 in the raised position with the vertical centerline Z-Axis on which the rides rotates and the horizontal centerline X-Axis which the oscillating arm assembly 12 moves back and forth on, along with the Y-Axis that the passenger carriage rotates on to keep the riders in the horizontal position. The rotational arrow and upward movement arrow indicate the directional movements of the oscillating arms when the ride is operating.

Figure 11:
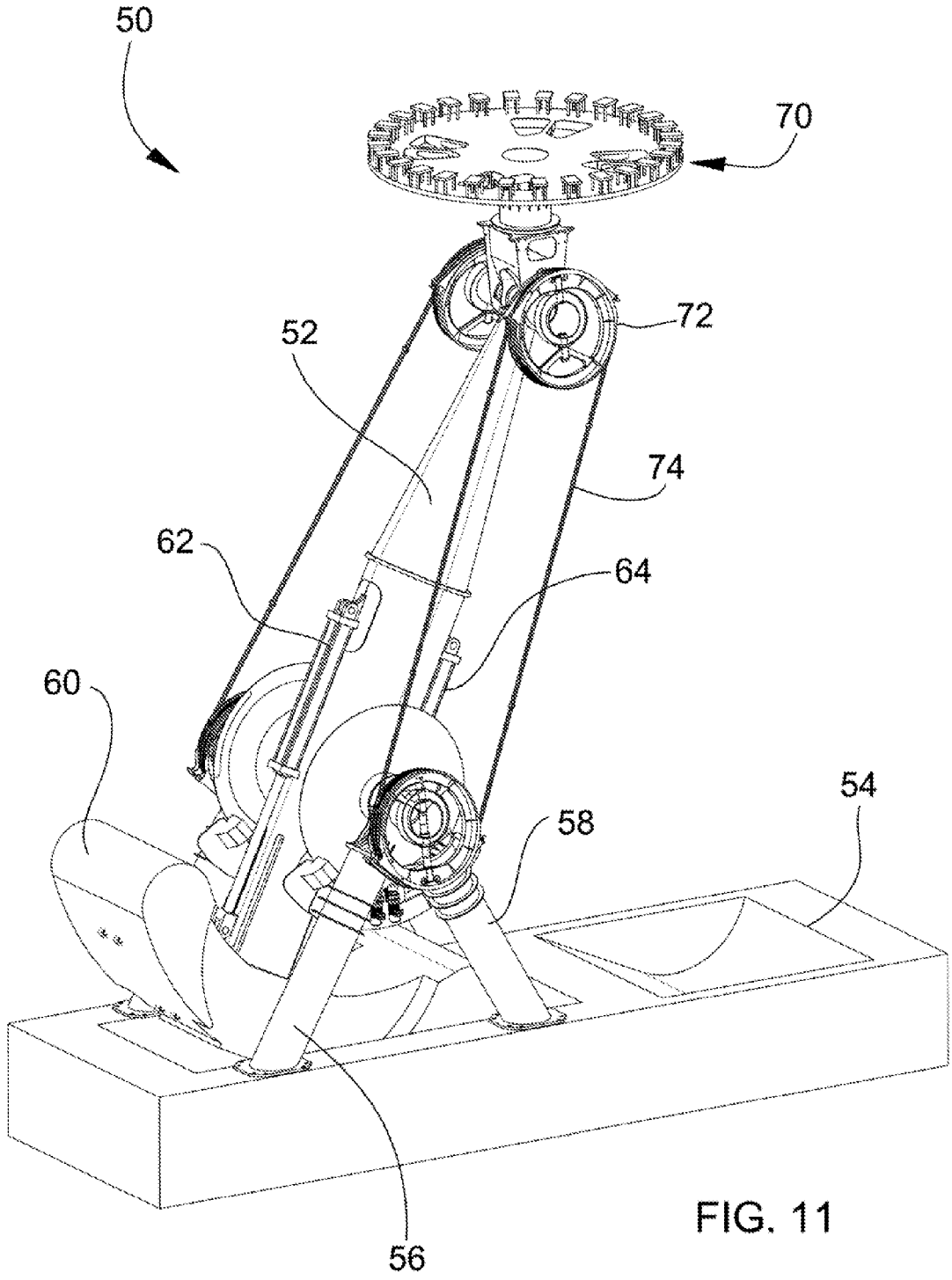
FIG. 11 depicts a perspective view of an alternate embodiment of a single arm hammer throw amusement ride, shown in the near peak position of the swing.

FIG. 11 depicts a perspective view of an alternate embodiment of a single arm hammer throw amusement ride 50, shown in the near peak position of the swing. The hammer throw ride 59 includes a swing arm 52 mounted to a base structure 54 using support legs 56 and 58. At one end of the swing arm 52 is a counterbalance weight 60 and at the opposite end of the swing arm there is a gondola mounting platform 70. The counterbalance weight 60 is adjustable along the swing arm 52 through the action of hydraulic, cylinders 62 and 64. A gimble 72 and cable 74 system maintain the proper aspect for the gondola platform 70 throughout the swinging motion of the amusement ride 50.

Figure 12:
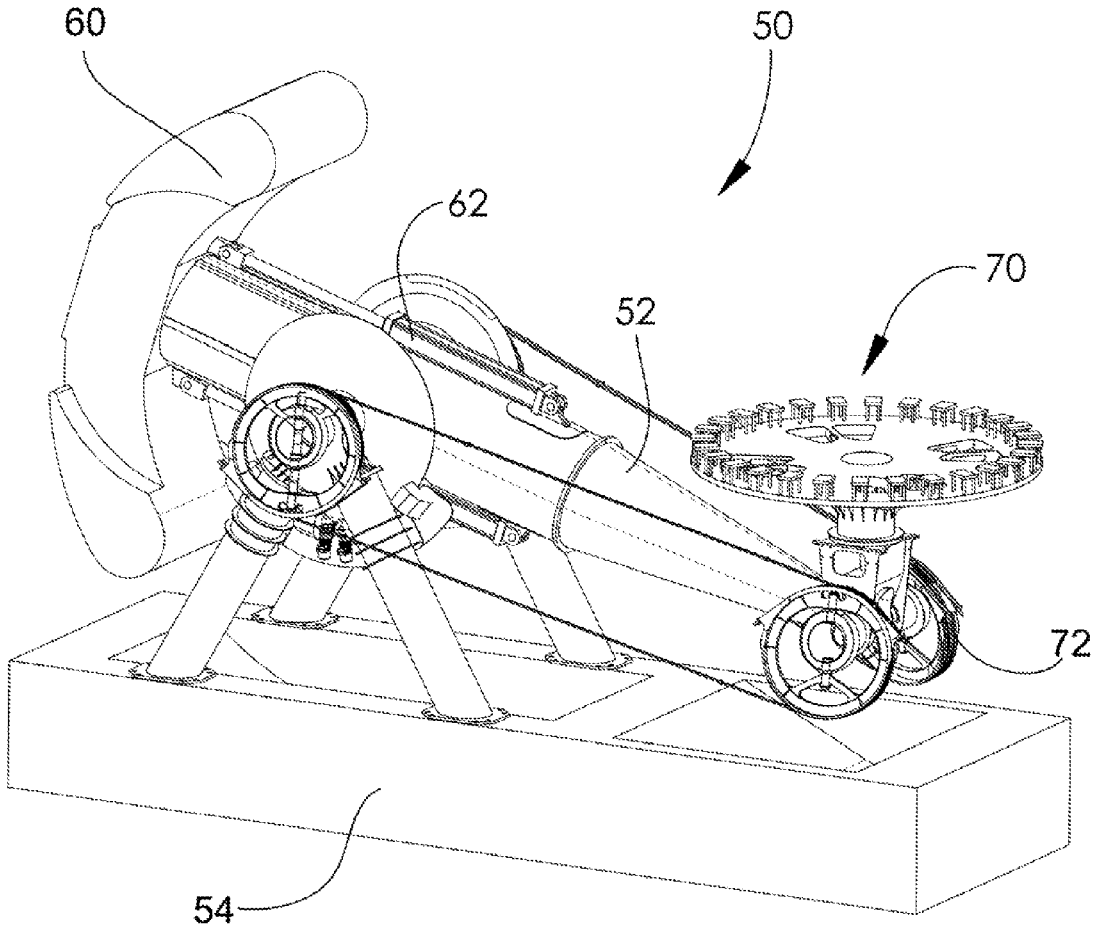
FIG. 12 depicts a perspective view of the single arm hammer throw amusement ride, shown in the fully down or loading position.

FIG. 12 depicts a perspective view of the single arm hammer throw amusement ride, shown in the fully down or loading position. Ride Motion can be described as follows: the ride motion is that of a pendulum with the !Mill are rotating around a central axle, swinging back and forth in an arc. The riders are positioned at the end of the arm, and at the opposite end of the arm is a large counterbalance, The counterbalance travels through the ride support leg while the swinging gives riders a floating sensation at the top of the swing. The gondola holding the riders always remains upright through a passive linkage system. A second ride motion is when the gondola rotates about its vertical axis. The maximum speed of this gondola rotation is low at 5 rpm, but the acceleration is large Riders are seated facing outward with in floorless seats with their legs dangling.

Figure 13:
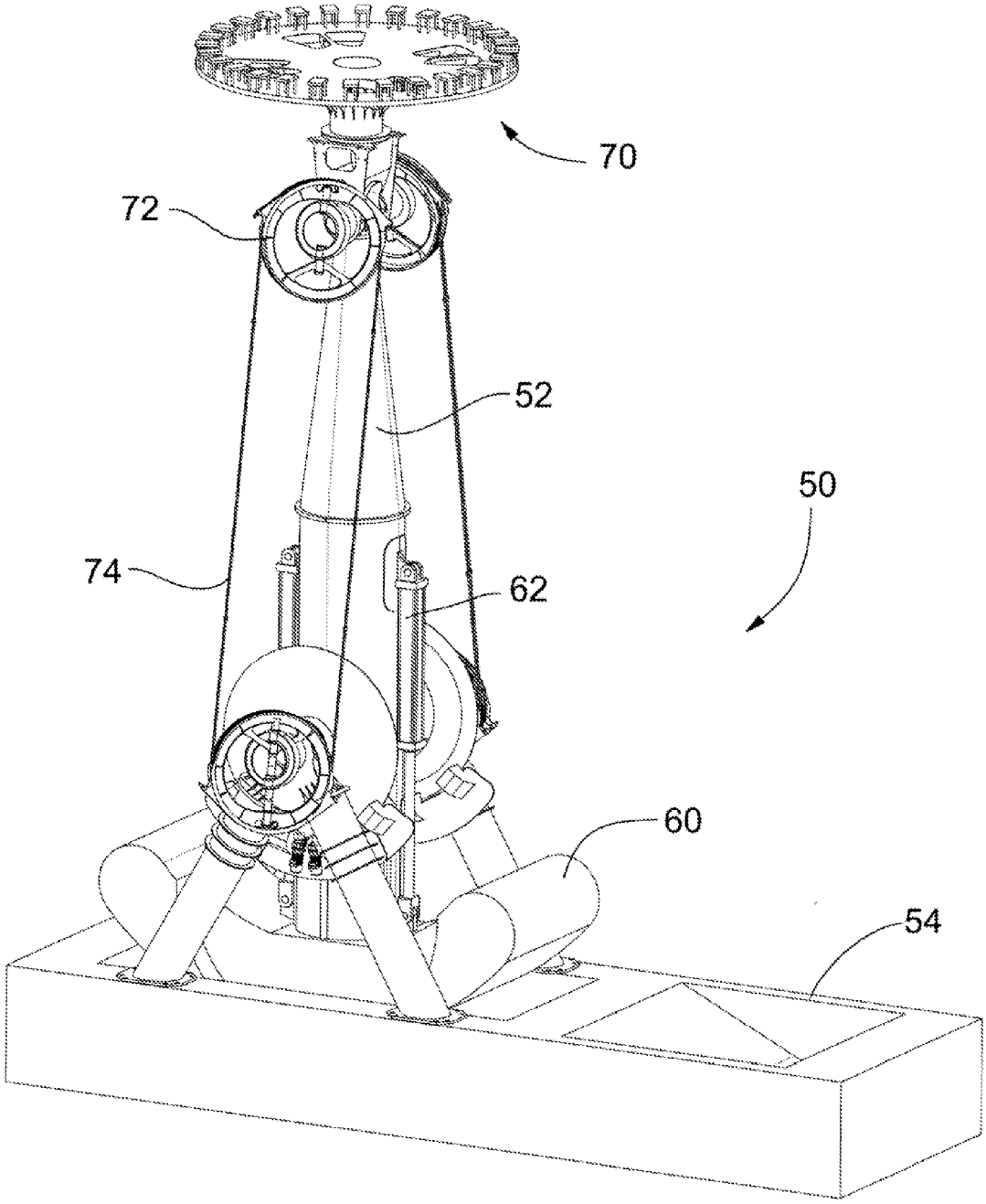
FIG. 13 depicts a perspective view of the single arm hammer throw amusement ride, shown in the fully up or peak position.

FIG. 13 depicts a perspective view of the single arm hammer throw amusement ride, shown in the fully up or peak position. The rider experience can be described as follows: After loading, the arm raises gradually to a minimum position where it stops as the loading condition is weighed. Suddenly, the riders feel an upwards thrust through the bottom of their seat as the ride catapults them towards the sky. As the arm moves upwards in its arc, this acceleration lessen and gradually turns into a forwards, backwards, or sideways pull depending on where the rider is seated. As the arm speed increases and the gondola reaches its apex, riders float up out of their seats into their secure restraints for over 1 second of airtime. Riders are literally catapulted while held securely in their seats. Past its apex the arm begins to slow to "catch" riders on the other side. The swing back to the original arm position occurs in the same pattern in the opposite direction. On the third arc, the gondola rotation begins at the apex. While riders are floating in their seats, the gondola turning kicks into gear to spin the seats about a vertical axis. The effective experience is to be tossed up and pushed suddenly to the side. As the arm changes directions the rotation will slow to a stop so the rotational acceleration can again occur at the ride apex. After swinging for roughly a minute, the arm will stop by its loading position.

Figure 14:
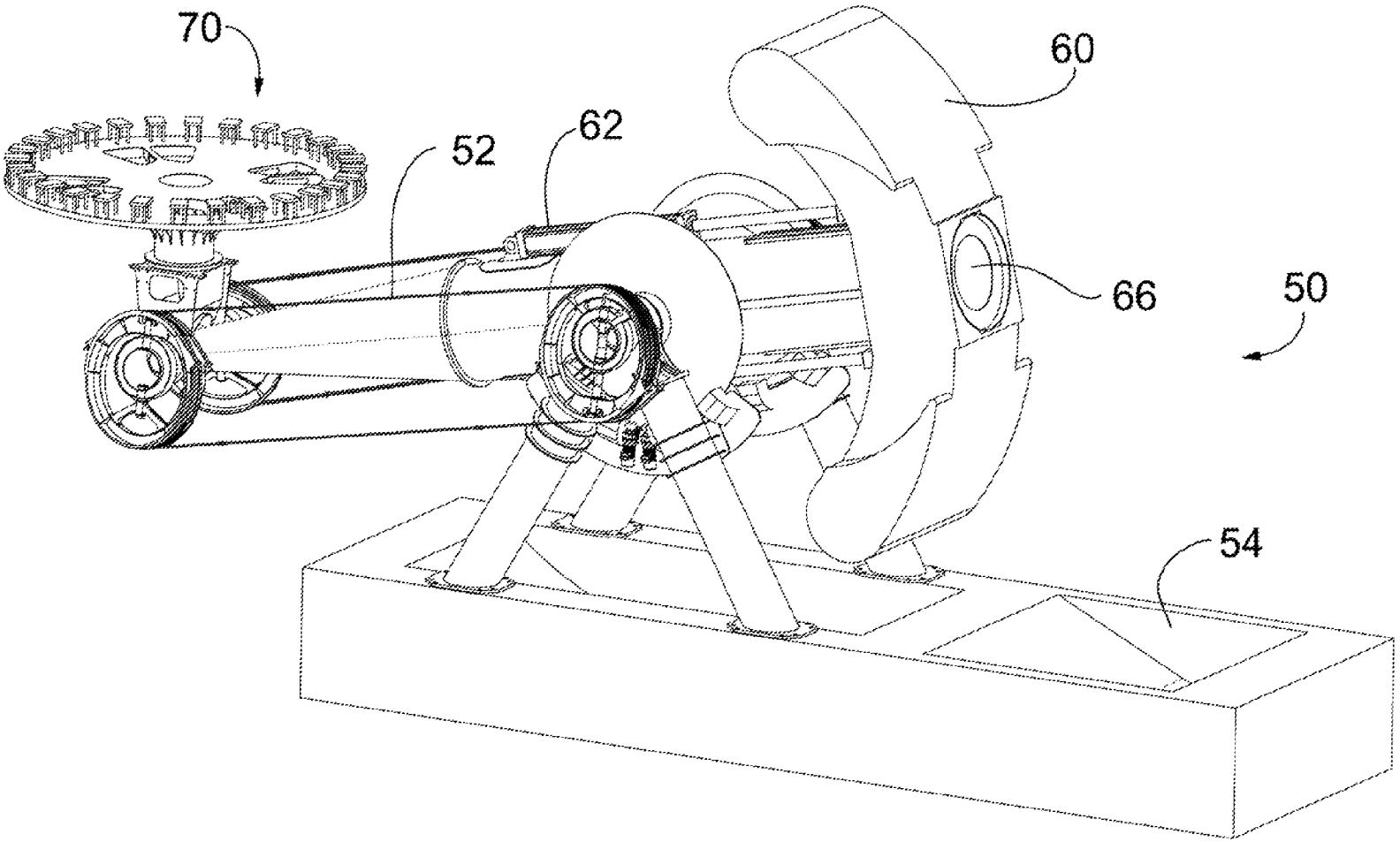
FIG. 14 depicts a perspective view of the single arm hammer throw amusement ride, shown in the fully thrown or completely opposite of the loading position.

FIG. 14 depicts a perspective view of the single arm hammer throw amusement ride, shown in the fully thrown or completely opposite of the loading position. FIG. 14 illustrates the adjustable counterbalance weight 60 in more detail by revealing, the orifice 66 in which the counterbalance weight travels when being adjusted by the hydraulic cylinders 62. In this view, the counterbalance weight 60 is fully extended downward for maximum counterbalance weight effect on the ride 50. The ride components can be described as follows: the hammer throw amusement ride has a mobile counterweight which is positioned through hydraulics. It is a redundant hydraulic system with each side capable of holding the counterweight in all conditions and each side monitored. The control valves are on the cylinder and the porting is hard plumbed, such that a hose failure does not have substantial safety influences. The purpose of the counterweight system is to offset the loading for each ride cycle so that the accelerations at the swing apex are consistent, as is the swing arc length. It has a second purpose of keeping the arm in a safe position during loading and unloading. The counterweight system does not move relative to the arm once the ride swinging motion begins. The counterweight has a slight offset to preface the side the arm comes down on to prevent instability at the top. There brakes on 2 arm rotors which can slow the arm motion and hold the arm in place while the counterweight position is adjusted. The E-STOP condition of these brakes is partially engaged for a slow stop. There are arm rotation motors soft coupled to the arm, also through the arm rotors. The power of this motor is limited such that the control system cannot overpower the arm on any single swing, provided that the arm started from a safe starting angle, which is evaluated every swing. The purpose of the this drive system is to offset losses (air drag, bearing friction, hydraulic friction) of the system during swinging.

The seating gondola can spin about its base while the ride is in operation. Seat rotation motors spin the seating gondola at a slow speed. The intent is to have the motors be relatively powerful so riders feel the acceleration of the motors, but the top speed will be relatively low and will be achieved quickly to prevent dizziness. The gondola base at the end of the arm is held upright through a redundant cabling system mounted on a partial gimble. The gondola seats 28 guests. The cabling system is passive, requiring no controls. The D/d ratio of the system is 96 and there is a 12 times safety factor on the cables. The system comprised of 4 independent cable loops, any of which would be sufficient to hold the ride upright by itself.

The ride sequence can be described as follows: During the loading position, the counterweight is located so that the position of the arm is down in all loading conditions. When guests are seated with restraints locked, the counterweight is able to move again, and the brakes are also unlocked. It moves to a position at which there is slow arm movement and then it stops. The position of the counterweight is monitored through linear transducers, and the position of the arm is also monitored through encoders. The arm position is then locked at −10 deg from horizontal. Based on the loading condition, which is determined by the lifting position of the counterweight, the hydraulics move the counterweight to a specific position. Once this position is achieved, the arm unlocks and the ride is free to swing back and forth. During the ride cycle the arm rotation motors compensate for friction, and air drag to achieve a prescribe swing angle and g-force at the swing apex. The seat rotation motors will turn on and of to spin the gondola about its vertical axis select times. The purpose of this angular rotation is to achieve quick acceleration to surprise riders, but the maximum gondola spinning is slow. The ride swings for many oscillations, each half swing taking 5 seconds. When the ride cycle is complete, the brakes slow the arm to a stop as close as possible to the loading position. The counterweight is raised slightly beyond its neutral position. The partially engaged brakes allow the arm to lower into its loading position. Once the arm is completely lowered, the hydraulics retract to lock the arm in its down position, and the brakes are partially engaged in their default state.

The following are some frequently asked questions which act to illustrate the reverse pendulum ride concept in greater detail:

What Makes the Cable System Safe and Reliable?

Wire ropes are used in the ride to hold the gondola upright. S&S has extensive experience with wire ropes so we know how to make a wire rope system safe with long life. This application is extremely simple in comparison with other rope applications S&S has successfully completed. The D/d cable ratio is an extremely large 96 (standards require 30). The cable system is passive, and it winds and unwinds around drum with a special plastic material to protect the cables. In addition, S&S works with wire rope industry experts to use specialized cable and cable terminations right for this application. On top of this the cables are accessible for routine maintenance inspections. The other side of the cable application is risk mitigation. The cable system is broken into 4 independent loops with a total safety factor comparable to elevator or ski lifts. Two loops are on each side of the ride, and any of the 4 loops has the strength to hold the gondola upright by itself. If there ever were a problem with a cable that did lead to a failure, the cables are passively connected to the adjacent loop so that a cable would not fall somewhere and cause a secondary failure.

What Keeps the Arm Stable and What Prevents the Arm from Swinging too Far?

Simple physics keep the arm oscillation stable. The arm will start with a minimum height oft the ground, and the motors helping swing, the arm are sized to be large enough to keep the arm swinging, but not large enough to over-swing the ride. In addition, the swing speed is independently monitored by a dedicated controls program so that an over-speed will cause the ride to fault and the brakes to slow the ride.

What if Someone Gets in the Way of the Counterweight?

The ride area is restricted access, and there should never be anyone in the ride area while the ride is running. However, as a simple backup measure, the counterweight is a minimum height off the ground for independent safety.

What Holds the Mobile Counterweight?

The counterweight is held by 2 hydraulic cylinders. Each cylinder has the capacity to hold the counterweight independent, of the other cylinder and they are each monitored to prevent a latent failure. Additionally, a control block is hard plumbed to each cylinder so there are no hydraulic hoses holding pressure while the ride is in operation.

What Happens if the Arm Stops in the Air?

A routinely checked recovery sequence can be initiated to safely lower the arm to the ground. The recovery sequence can be completed in the order of minutes. In the event of a power loss, a backup generator may be employed to safely lower the arm.

EXAMPLE 1

Possible Hammer Throw Ride Statistics

Passengers: 28
Ride Time: 60 seconds
Theoretical Capacity: 600
Power System: Electrical & Hydraulic
Restraints: Redundantly Locked and Monitored Over-the-Shoulder, ASTM category 5.
Bib style soft padding. Music optional.

Max rider Height: 65 feet
Clearance Envelope: 102×28 feet
Ride Category: High Thrill/family (riders always upright)
Minimum Rider Height: 42"
Ride Power Consumption: 120 kW/160 hp
Accelerations
  Vertical: −1 to 2 g's (1 n is normal)
  Longitudinal/Lateral: −1.2 to 1.2 g's
Gondola Max Rotation Speed: 5 rpm
Arm Max Rotation Speed: 7 rpm
Arm Rotation Angle: +/−100 degrees while running (0 degrees is vertical)
Seating: outward facing, floorless
Standards which can be et: ASTM F24, EN 13814, GB 8408, AS 3533.1
The Hammer Throw has the same arm technology except it has a large single arm. This ride does not necessarily have a sync cylinder system. Instead, it has a braking rotor to stop the arm and hold it in position when the mobile counterweight is moving. The seats spin about a vertical axis, but this is a controlled (motorized) spin on the hammer throw.

Figure 15:
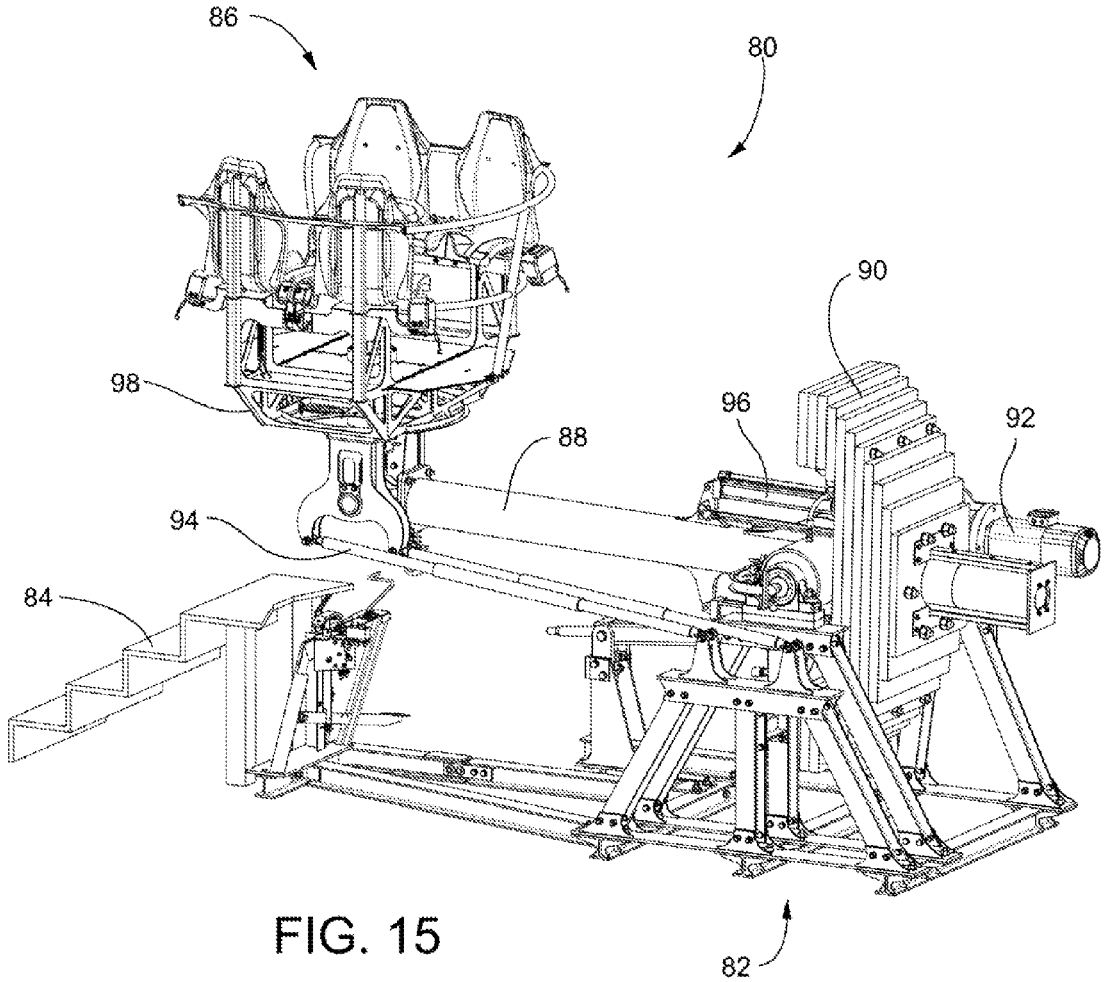
FIG. 15 depicts a perspective view of a second alternate embodiment of a single arm ground based amusement ride, shown in the fully down or the loading position.

FIG. 15 depicts a perspective view of a second alternate embodiment of a single arm ground based amusement ride 80, shown in the fully down or the loading position. This amusement ride is ground based and supported by a base assembly 82 having a plurality of support legs. A loading area may have a stairway 84 to accommodate riders loading into a gondola 86 attached to a gondola platform assembly 98. The swing arm 88 is attached to the gondola platform assembly 98 at one end and a counterbalance weight 90 at the opposite end. The counterbalance weight 90 is adjustable along the swing arm 88 through the action of hydraulic cylinder 96. A gear-motor 92 is also partially shown, and will be described in greater detail below (see FIG. 20 and FIG. 21). Tie rods 94 and 95 (with tie rod 95 seen only in FIG. 16 and FIG. 17) connect to the base assembly 82 on one end and the gondola platform assembly on the other end, and act to stabilize the gondola 86.

Figure 16:
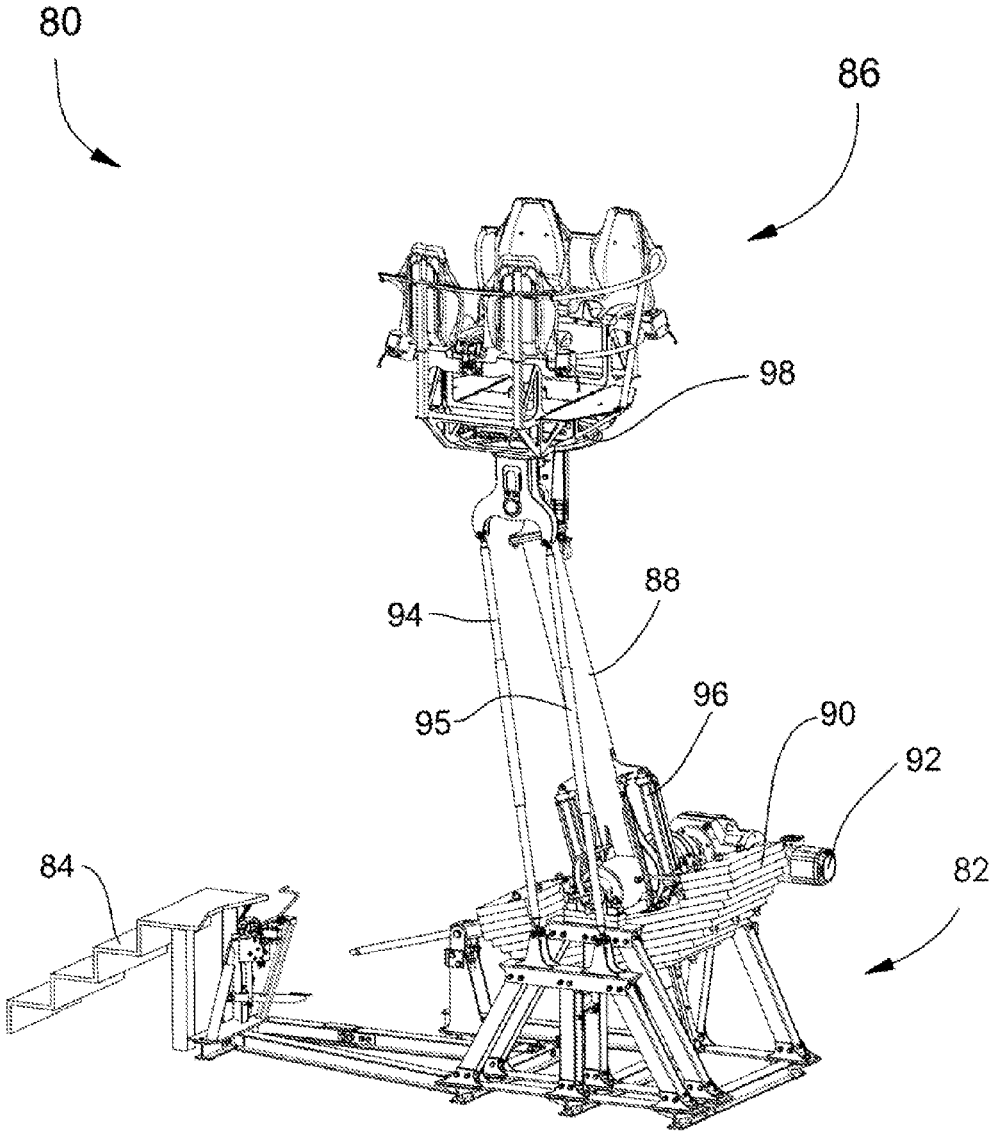
FIG. 16 depicts a perspective view of a second alternate embodiment of a single arm ground based amusement ride, shown in the near fully up or near peak position.

FIG. 16 depicts a perspective view of a second alternate embodiment of a single arm ground based amusement ride 80, shown in the near fully up or near peak position. Tie rods 94 and 95 are clearly seen in this FIG. 16 illustration. We want to emphasize that the concept of that is of a "reverse swing". The ride motion is that of a pendulum, expect the riders are positioned opposite of the center of gravity. The ride motion is similar to a trebuchet action, which has never been done before in the amusement industry. There are at least 2 more rides based off the same "reverse pendulum" technology which we will be making: the ground based "Mini Hu," (see FIGS. 11-14) and the "Hammer Throw" 50 (see FIGS. 15-23). The Mini Hu 80 has the same arm technology as the Huli Hu 10 (see FIGS. 1-11), but the base structure is fixed to the ground, whereas the Huli Hu 10 rotates. The Mini Hu 80 can have as few as one arm. The seats are free-spinning. See the drawing figures below for more detail.

Figure 17:
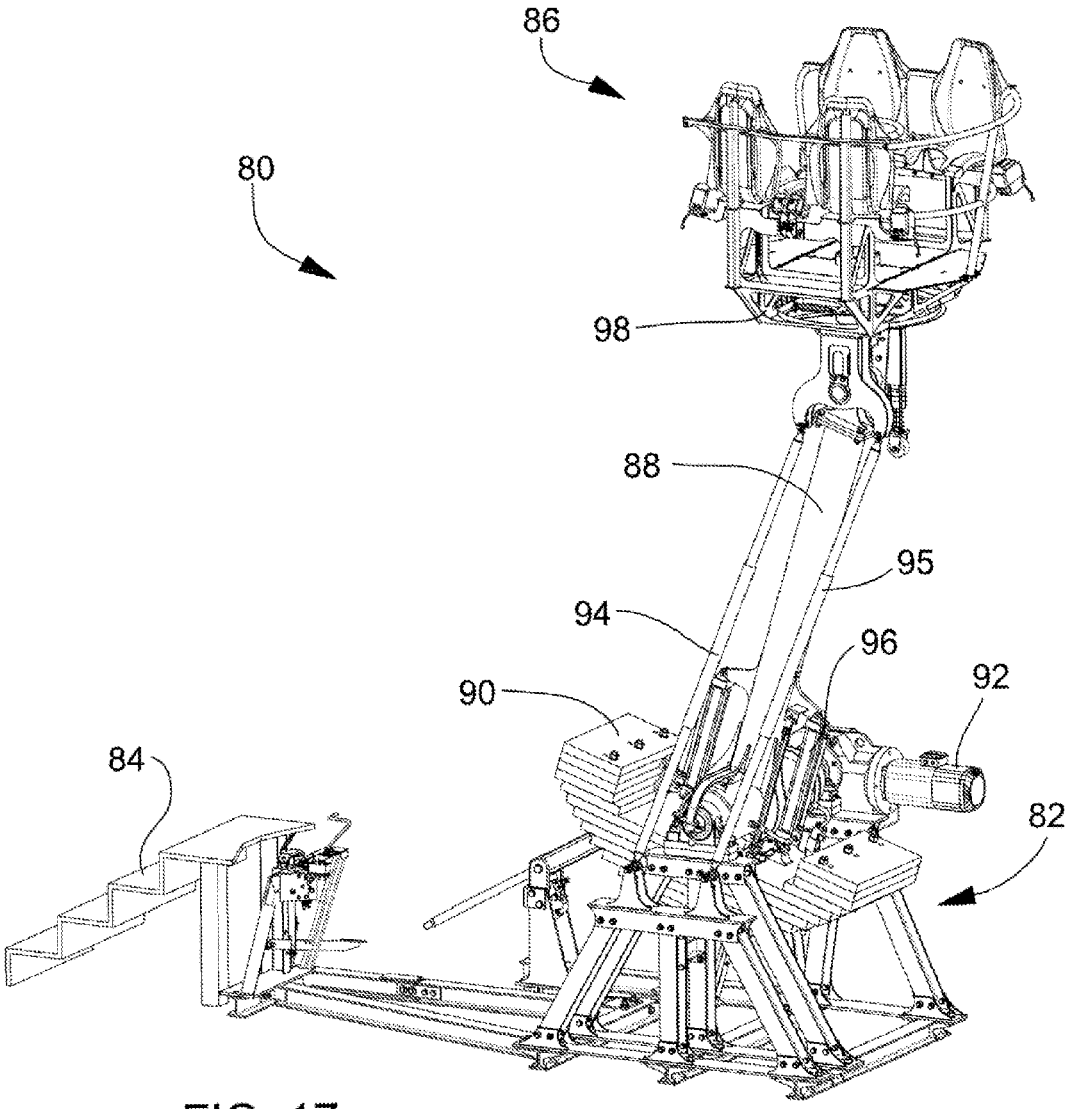
FIG. 17 depicts a perspective view of a second alternate embodiment of a single arm ground based amusement ride, shown in the near fully up or near peak position having swung past the peak position and on the way down.

FIG. 17 depicts a perspective view of a second alternate embodiment of a single arm ground based amusement ride, shown in the near fully up or near peak position having swung past the peak position and on the way down. The gear-motor 92 is clearly seen in this illustration of FIG. 17. The ride motion can be described as follows: The Mini Hu is a powered reverse swing that rotates in an arc. The ride has two counterbalanced lever arms, each with a cart containing four passengers seated in a teacup-style circular pattern, for a total of eight passengers. Each of the individual four-passenger vehicles can freely turn or spin as the passengers turn a wheel in the center. Ride motion is that of a pendulum, each lever arm rotating around a central axle counterbalanced by a mass, swinging in an arc.

Figure 18:
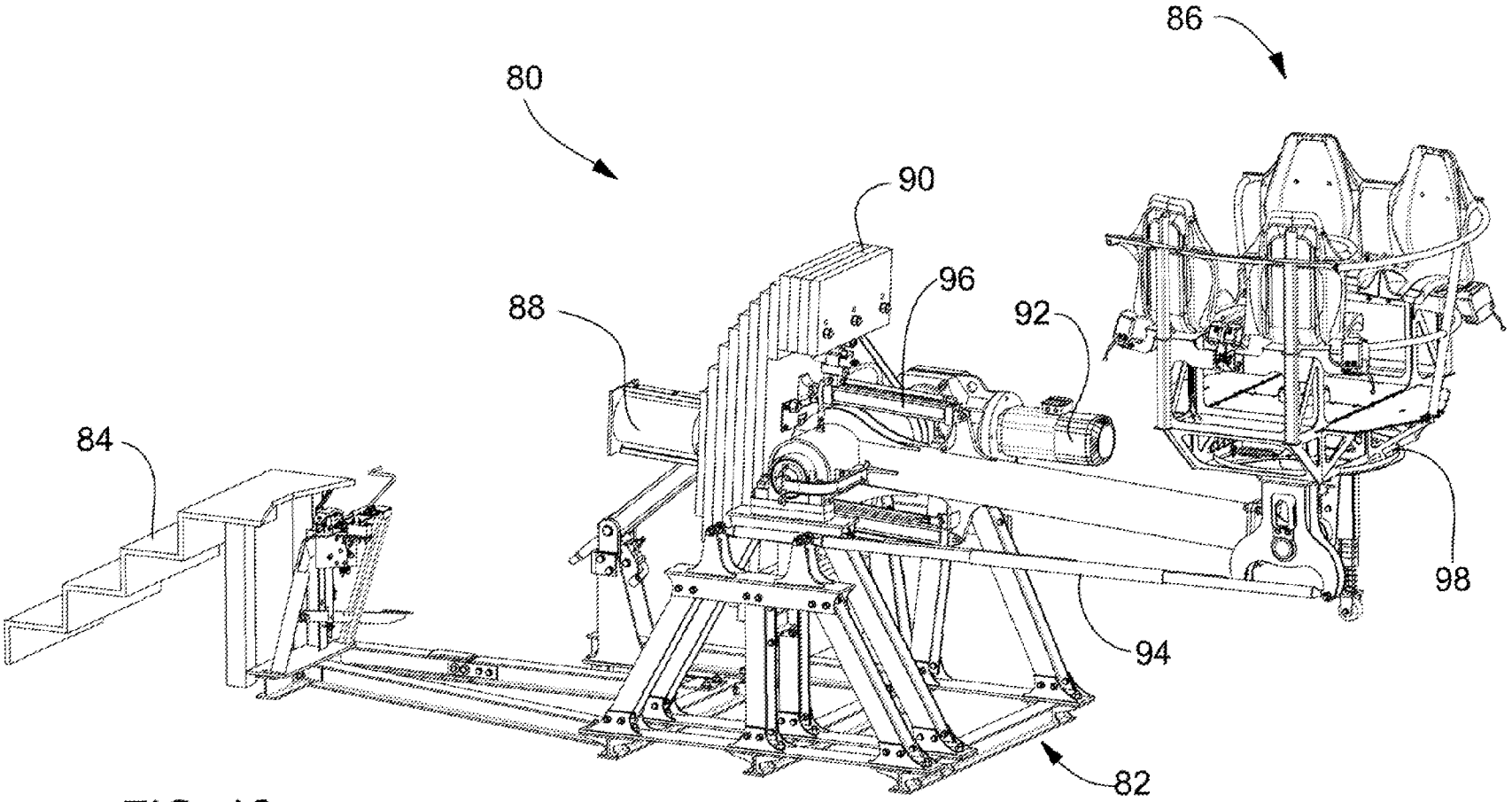
FIG. 18 depicts a perspective view of a second alternate embodiment of a single arm ground based amusement ride, shown in the full down position opposite of the loading position, having swung past the peak position and all the way down.

FIG. 18 depicts a perspective view of a second alternate embodiment of a single arm ground based amusement ride 80, shown in the fully down position opposite of the loading position, having, swung past the peak position and all the way down. The counterbalance weight 90 is adjustable along the swing arm 88 through the action of hydraulic cylinder 96. Here the counterbalance weight 90 has been adjusted upwardly along swing arm 88, such that the end of swing arm 88 opposite of the gondola 86 is now exposed. The counterbalance weight is adjusted through the actuation of hydraulic cylinders system 96. The ride components can be described as follows: The Mini Hu has a mobile counterweight which is positioned through hydraulics. It is a redundant hydraulic system with each side capable of holding the counterweight in all conditions and each side monitored. The control valves are on the cylinder and the porting is hard plumbed, such that a hose failure does not have substantial safety influences. The purpose of the counterweight system is to offset the loading for each ride cycle so that the accelerations at the swing apex are consistent, as is the swing arc length. It has a second purpose of keeping the arm in a safe position during loading and unloading. The counterweight system does not move relative to the arm once the ride swinging motion begins. There is a "synchronous" cylinder connected to a lever fixed to the arm. The influence of this cylinder changes due to the position of the arm, with its greatest influence being when the arm is horizontal. The purpose of this cylinder is 4 fold. It can lock the arm in the unloading position, it can lock the arm to position the counterweight at the beginning of the ride cycle, it synchronizes the arm movements when there are multiple arms in operation, and it slows the arm movement during an E-STOP. The synchronous hydraulic circuit is defaulted to be open with restricted flow, which is the E-STOP condition position. The circuit may only be locked when there is little or no movement of the arm. There is a gear-motor directly coupled to the arm. The power of this motor is limited such that the control system cannot overpower the arm on any single swing, provided that the arm started from a safe starting angle, which is evaluated every swing. The purpose of the gear-motor is to offset losses (air drag, bearing friction, hydraulic friction) of the system during swinging. The gondola base at the end of the arm is held upright through a redundant tie rod system. The gondola is free to spin about its base while the ride is in operation. Each gondola seats 4 guests. It may be a single arm or multiple arms, but its base does not move relative to the ground. The new concept is the fast reverse pendulum/catapult action. Also critical in achieving consistency to that is the mobile counterweight, which allows the same rider experience for different loading conditions.

Figure 19:
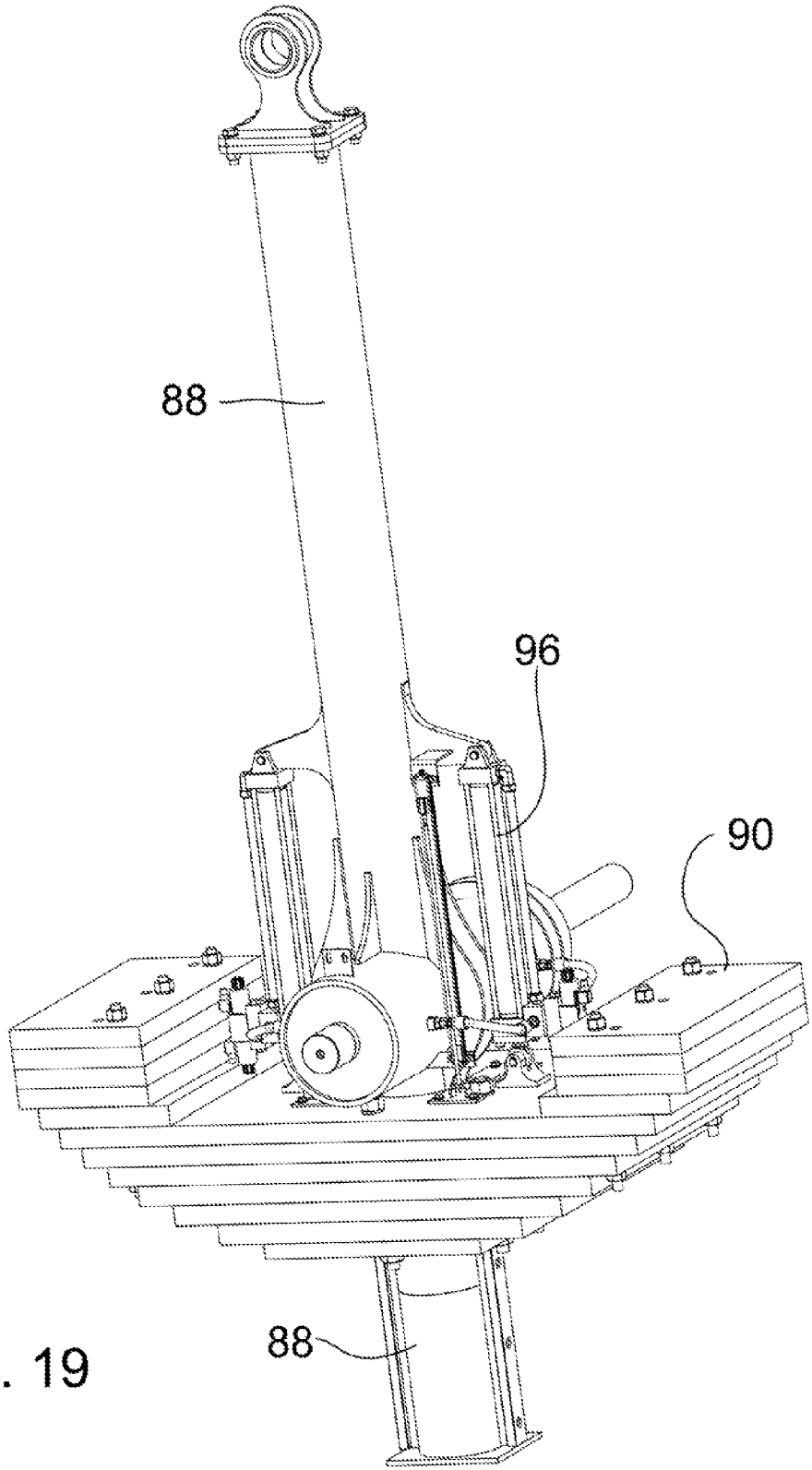
FIG. 19 depicts a perspective view of a partially assembled swing arm and counterbalance weight assembly, showing the detail of the hydraulic adjustment system.

FIG. 19 depicts a perspective view of a partially assembled swing arm 88 and counterbalance weight 90 assembly, showing the detail of the hydraulic adjustment system 96. A mobile (moveable) counterweight is employed to weight the loading condition and to achieve desired g-force at the top of the swing. The run position of this counterweight will be based off the loading condition of the riders. The movement is done hydraulically, but can be done with other actuators such as screw jacks, and the mobile counterweight has a feedback system to know its position.

Figure 20:
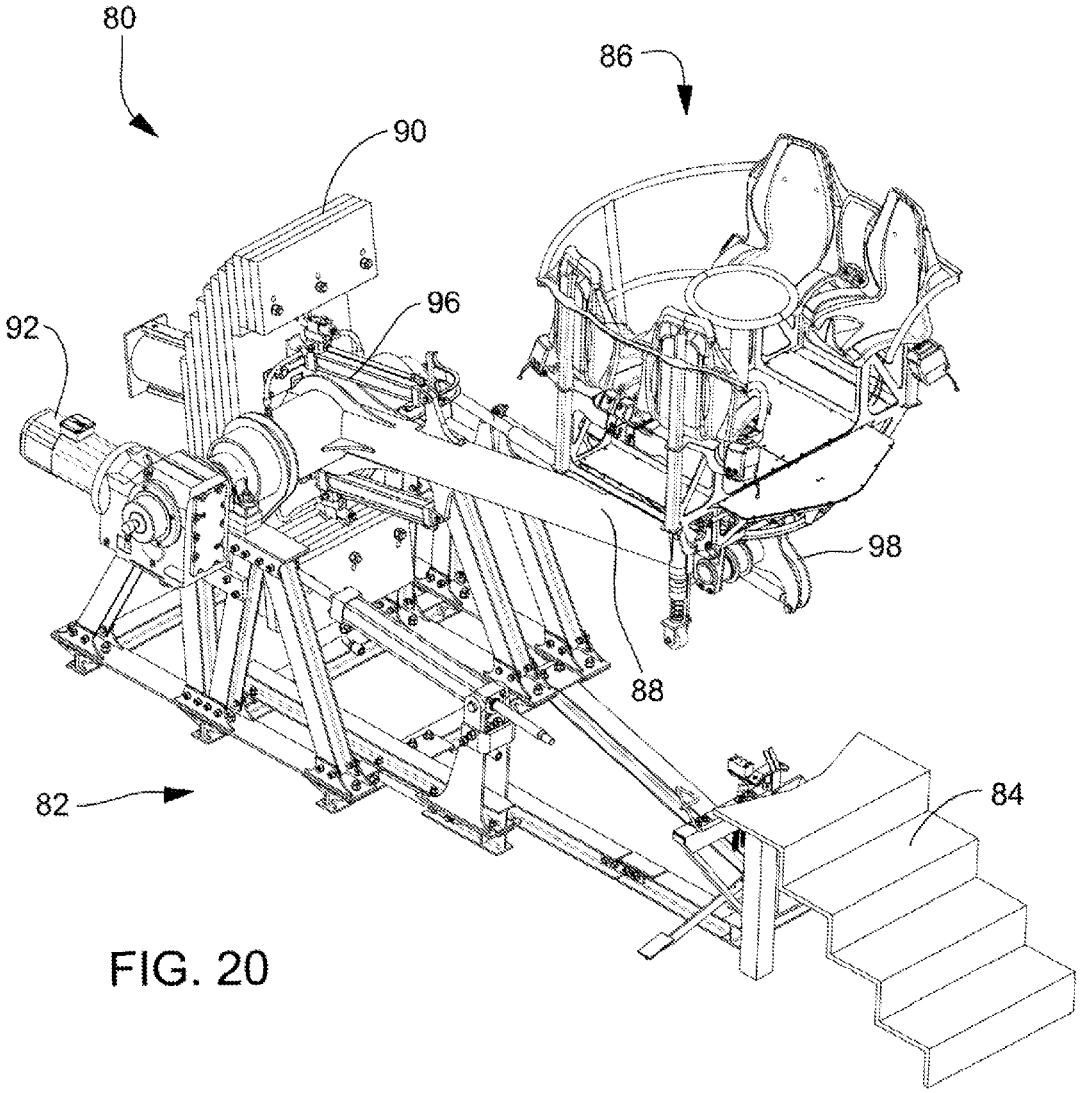
FIG. 20 depicts a perspective view of a second alternate embodiment of a single arm ground based amusement ride, shown in the near fully down or near loading position having swung past the peak position and on the way down.

FIG. 20 depicts a perspective view of a second alternate embodiment of a single arm ground based amusement ride, shown in the near fully down or near loading position having swung past the peak position and on the way down. In this view, the detail of the gear-motor assembly 92 and its relation to the swing arm 88 is shown in greater detail.

Figure 21:
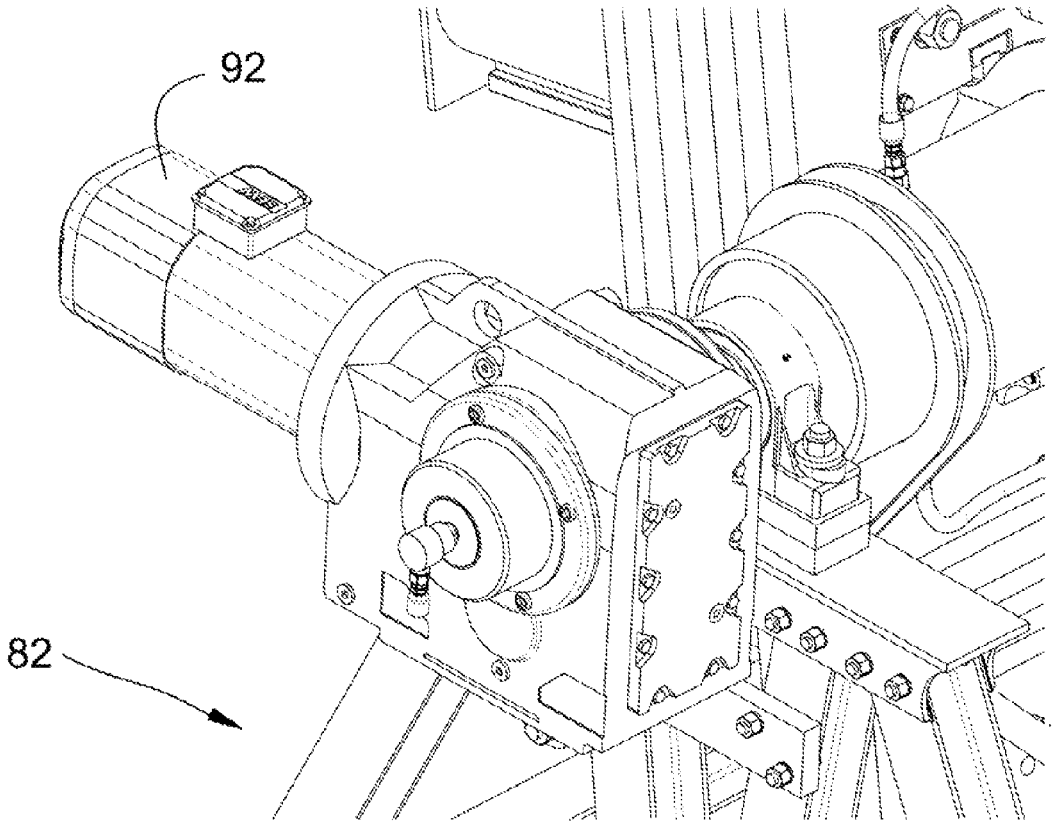
FIG. 21 depicts a perspective view of a partially assembled gear-motor assembly showing the detail of the gear-motor assembly mounted on the base structure.

FIG. 21 depicts a perspective view of a partially assembled gear-motor assembly 92 showing the detail of the gear-motor assembly 92 mounted on the base support structure 82. A minimally sized shaft mounted motor is employed to compensate for losses and keep the arm swinging. This would not need to be done in-line with shaft, but could be configured in alternate ways.

Figure 22:
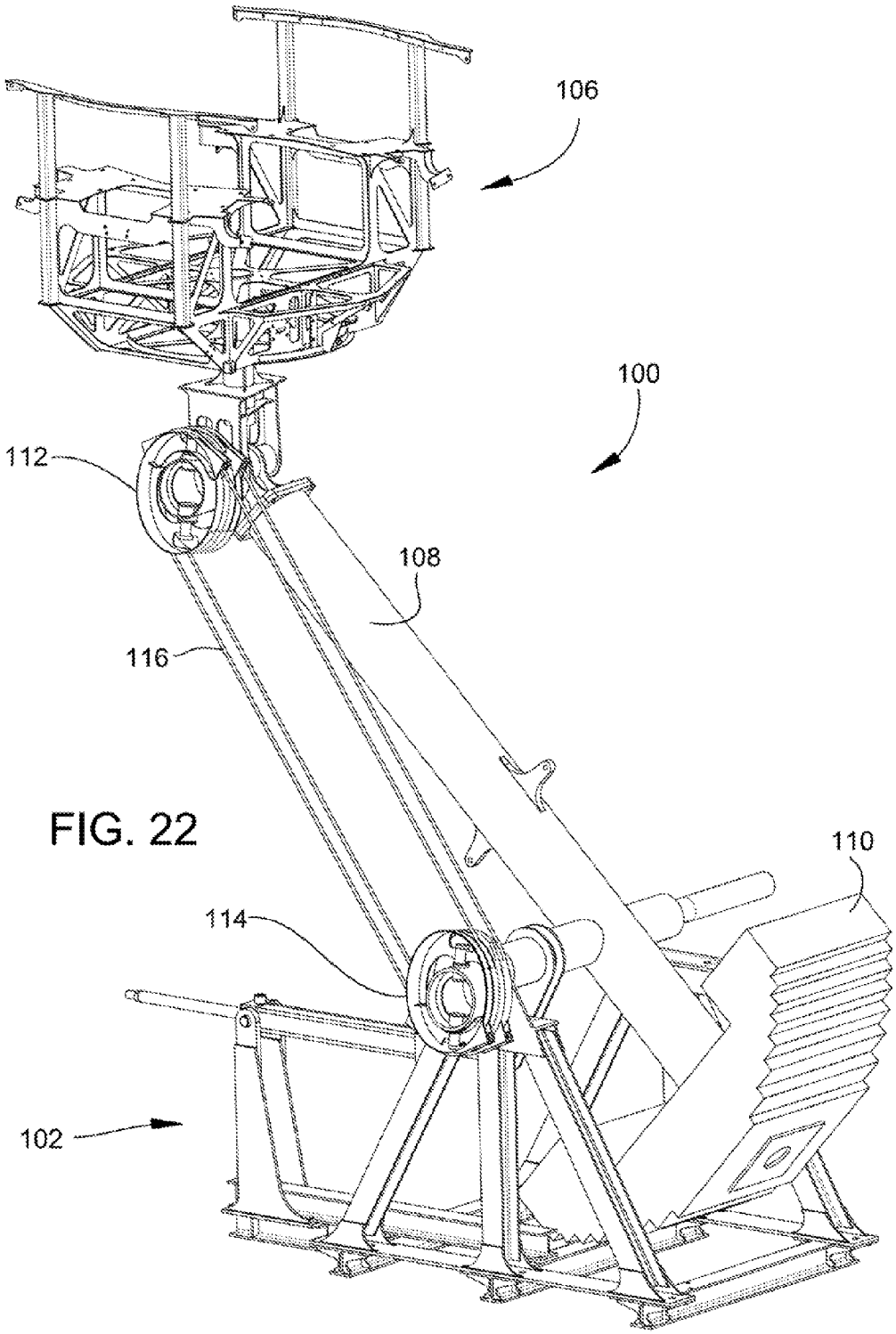
FIG. 22 depicts a perspective view of a third alternate embodiment of a single arm ground based amusement ride having a gimble and cable system assembly.

FIG. 22 depicts a perspective view of a third alternate embodiment of a single arm ground based amusement ride 100 having a gimble 112 and 114 and cable 116 system assembly. The swing arm 108 includes a counterbalance weight 110 attached to one end and a gondola 106 attached to the opposite end. The entire structure is supported by a ground based base assembly 102. The tie rods, which keep the seats in an upright position, can be replaced with a cable and gimble system. The rotating gimble system allows the cable drums to be offset, but in different incarnations drum can be rigidly fixed to the seat base and ride base. This offset gimble design is novel to the amusement ride industry, and has not been employed prior to this invention. Alternatively, this effect could also be accomplished using a transmission system.

Figure 23:
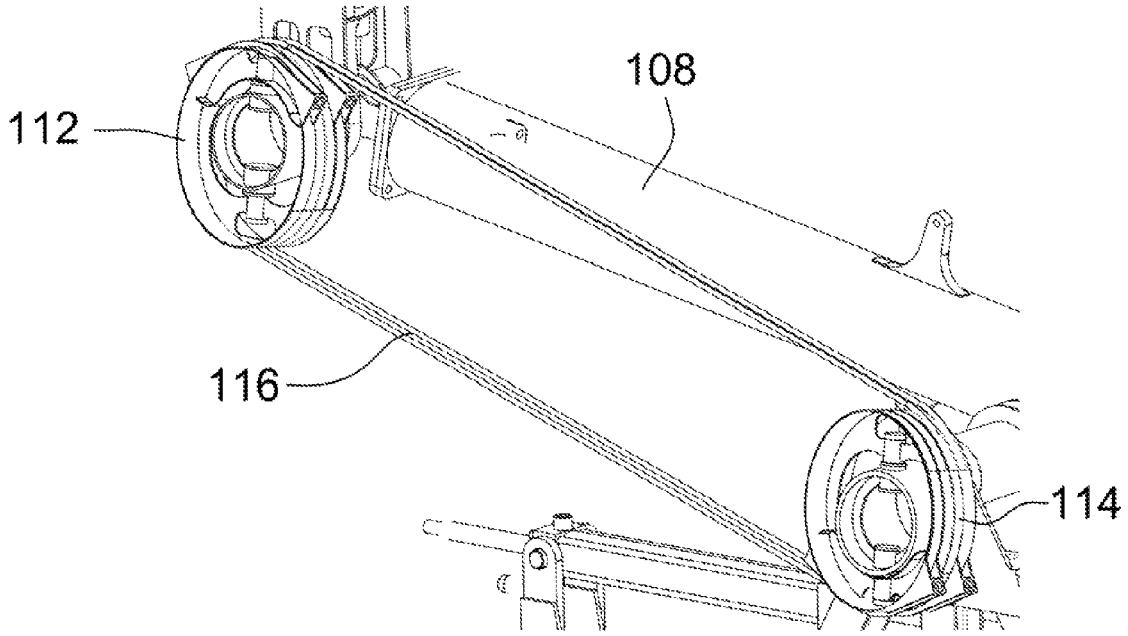
FIG. 23 depicts a perspective view of a partially assembled swing arm and gimble and cable system showing details of the gimble and cable system.

FIG. 23 depicts a perspective view of a partially assembled swing arm and gimble 112 and 114 and cable 116 system showing details of the gimble and cable system in relation to the swing arm 108.

The multiple arm oscillating, rotating amusement ride 10, the hammer throw amusement ride embodiment 50, and the single arm ground based amusement ride 80, and the gimble and cable system amusement ride 100, shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a multiple arm oscillating, rotating amusement ride 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A multiple arm oscillating and rotating amusement ride comprising:

a) one or more oscillating arm assemblies having tubular support members supporting one or more passenger carriages on one end and a counter balance weight on the other end;

b) a truss support unit supporting an upper rotational drive support structure;

c) a primary support structure connecting said tubular support members to said upper rotational drive support; and d) wherein said passenger carriages further include a carriage mounting shaft, a carriage bearing and a spring cushion mechanism and are swung upwardly and downwardly by a drive cylinder and are stabilized via a primary safety synchronization cylinder and a secondary safety synchronization cylinder;

whereby said one or more oscillating arm assemblies supporting one or more passenger carriages rotate around the main ride vertical axis on a standard gear crane bearing rotational drive system attached thereto via a truss support unit and a lever arm, such that the plane of oscillation of said one or more oscillating arms intersects the main ride vertical axis, such that adjacent oscillating arms cannot collide with each other.

2. The multiple arm oscillating and rotating amusement ride according to claim 1, wherein said one or more oscillating arm assemblies having tubular support members supporting one or more passenger carriages on one end and a counter balance weight on the other end, include pivoting carriage mounting frames and passenger carriage support bars.

3. The multiple arm oscillating and rotating amusement ride according to claim 1, wherein said truss support unit supporting an upper rotational drive support structure houses one or more oscillating arm upper sections.

4. The multiple arm oscillating and rotating amusement ride according to claim 1, wherein said primary support structure connecting said tubular support members to said upper rotational drive support structure connects through a horizontal tubular frame member.

5. The multiple arm oscillating and rotating amusement ride according to claim 1, wherein said passenger carriages further include a carriage mounting shaft, a carriage bearing and a spring cushion mechanism and are swung upwardly and downwardly by a drive cylinder.

6. The multiple arm oscillating and rotating amusement ride according to claim 5, wherein said passenger carriages are stabilized via a primary safety synchronization cylinder and a secondary safety synchronization cylinder.

7. A method for making a multiple arm oscillating and rotating amusement ride, comprising the steps of:

a) providing one or more oscillating arm assemblies having tubular support members supporting one or more passenger carriages on one end and a counter balance weight on the other end;

b) providing a truss support unit supporting an upper rotational drive support structure;

c) providing a primary support structure connecting said tubular support members to said upper rotational drive support; and d) wherein said passenger carriages further include a carriage mounting shaft, a carriage bearing and a spring cushion mechanism and are swung upwardly and downwardly by a drive cylinder and are stabilized via a primary safety synchronization cylinder and a secondary safety synchronization cylinder;

whereby said one or more oscillating arm assemblies supporting one or more passenger carriages rotate around the main ride vertical axis on a standard gear crane bearing rotational drive system attached thereto via a truss support unit and a lever arm, such that the plane of oscillation of said one or more oscillating arms intersects the main ride vertical axis, such that adjacent oscillating arms cannot collide with each other.

8. The method for making a multiple arm oscillating and rotating amusement ride according to claim 7, wherein said one or more oscillating arm assemblies having tubular support members supporting one or more passenger carriages on one end and a counter balance weight on the other end, include pivoting carriage mounting frames and passenger carriage support bars.

9. The method for making a multiple arm oscillating and rotating amusement ride according to claim 7, wherein said truss support unit supporting an upper rotational drive support structure houses one or more oscillating arm upper sections.

10. The method for making a multiple arm oscillating and rotating amusement ride according to claim 7, wherein said primary support structure connecting said tubular support members to said upper rotational drive support structure connects through a horizontal tubular frame member.

11. The method for making a multiple arm oscillating and rotating amusement ride according to claim 7, wherein said passenger carriages further include a carnage mounting shaft, a carriage bearing and a spring cushion mechanism and are swung upwardly and downwardly by a drive cylinder.

12. The method for making a multiple arm oscillating and rotating amusement ride according to claim 11, wherein said passenger carriages are stabilized via a primary safety synchronization cylinder and a secondary safety synchronization cylinder.

13. A reverse pendulum single arm platform based amusement ride comprising:

(a) a swing arm mounted to a base structure having support legs;

(b) a moveable adjustable counterbalance weight mounted at one end of the swing arm;

(c) a gondola mounting platform mounted at the opposite end of the swing arm having a gondola affixed thereto, wherein said gondola mounting platform mounted at the opposite end of the swing arm having a gondola affixed thereto includes one or more tie rods to stabilize the gondola and maintain an upright position of the gondola; and further wherein said gondola mounting platform mounted at the opposite end of the swing arm having a gondola affixed thereto includes one or more gimbles and cables to maintain the proper aspect for the gondola throughout the swinging motion of the amusement ride: and (d) hydraulic cylinders connected to said counterbalance weight for the purpose of moving and adjusting the position of the counterbalance weight along the swing arm.

14. The reverse pendulum single arm amusement ride according to claim 13, wherein said ride is ground based having said base structure on the ground.

15. The method for making a reverse pendulum single arm amusement ride according to claim 13, wherein said ride is platform based having said base structure connected to a platform structure.

16. A method for making a reverse pendulum single arm amusement ride comprising the steps of:

(a) providing a swing arm mounted to a base structure having support legs;

(b) providing a moveable adjustable counterbalance weight mounted at one end of the swing arm;

(c.) providing a gondola mounting platform mounted at the opposite end of the swing arm having a gondola affixed thereto wherein said gondola mounting platform mounted at the opposite end of the swing aim having a gondola affixed thereto includes one or more tie rods to stabilize the gondola and maintain an upright position of the gondola; and further wherein said gondola mounting platform mounted at the opposite end of the swing UM having a gondola affixed thereto includes one or more gimbles and cables to maintain the proper aspect for the gondola throughout the swinging motion of the amusement ride; and;

(d) providing hydraulic cylinders connected to said counterbalance weight for the purpose of moving and adjusting the position of the counterbalance weight along the swing arm.

17. The method for making a reverse pendulum single arm amusement ride according to claim 16, wherein said ride is ground based.

18. The method for making a reverse pendulum single arm amusement ride according to claim 16, wherein said ride is platform based.

* * * * *